US006243559B1

(12) United States Patent
Kurotaka et al.

(10) Patent No.: US 6,243,559 B1
(45) Date of Patent: Jun. 5, 2001

(54) BELT FIXING DEVICE

(75) Inventors: Shigeo Kurotaka, Kanagawa; Kazumasa Hirai, Tokyo, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/269,736

(22) PCT Filed: Oct. 2, 1997

(86) PCT No.: PCT/JP97/03530

§ 371 Date: May 12, 1999

§ 102(e) Date: May 12, 1999

(87) PCT Pub. No.: WO98/14837

PCT Pub. Date: Apr. 9, 1998

(30) Foreign Application Priority Data

| | | |
|---|---|---|
| Oct. 4, 1996 | (JP) | 8-264030 |
| Oct. 30, 1996 | (JP) | 8-288683 |
| Dec. 13, 1996 | (JP) | 8-333896 |
| Dec. 24, 1996 | (JP) | 8-343711 |
| Mar. 5, 1997 | (JP) | 9-050000 |
| Mar. 5, 1997 | (JP) | 9-050001 |
| Jun. 16, 1997 | (JP) | 9-158704 |

(51) Int. Cl.[7] ..... G03G 15/20
(52) U.S. Cl. ..... 399/329; 219/216
(58) Field of Search ..... 399/329, 328, 399/320; 219/216

(56) References Cited

U.S. PATENT DOCUMENTS

| | | | | |
|---|---|---|---|---|
| 5,250,998 | * | 10/1993 | Ueda et al. | 399/329 |
| 5,359,401 | * | 10/1994 | Uehara et al. | 399/67 |
| 5,450,182 | | 9/1995 | Wayman et al. . | |
| 5,465,146 | | 11/1995 | Higashi et al. . | |
| 5,614,999 | * | 3/1997 | Kanesawa et al. | 399/329 |
| 5,778,294 | * | 7/1998 | Hiraoka et al. | 399/329 |
| 5,832,353 | * | 11/1998 | Sano | 399/329 |
| 5,873,020 | * | 2/1999 | Matsuura et al. | 399/329 |
| 5,907,348 | * | 5/1999 | Ogasawara et al. | 347/212 |
| 6,055,390 | * | 4/2000 | Kurotaka et al. | 399/69 |

FOREIGN PATENT DOCUMENTS

| | | |
|---|---|---|
| 0 707 244 | 4/1996 | (EP) . |
| 52-69337 A | 6/1977 | (JP) . |
| 52-102736 A | 8/1977 | (JP) . |
| 60-151678 A | 8/1985 | (JP) . |
| 60-159874 A | 8/1985 | (JP) . |
| 61-162074 A | 7/1986 | (JP) . |
| 1-144084 | 6/1989 | (JP) . |
| 2-58269 U | 4/1990 | (JP) . |
| 3-125173 A | 5/1991 | (JP) . |
| 4-50883 | 2/1992 | (JP) . |
| 4-342277 | 11/1992 | (JP) . |
| 4-358190 A | 12/1992 | (JP) . |
| 4-362984 A | 12/1992 | (JP) . |
| 5-80666 | 4/1993 | (JP) . |
| 6-214484 A | 8/1994 | (JP) . |
| 8-44228 A | 2/1996 | (JP) . |
| 8-262892 | 10/1996 | (JP) . |

* cited by examiner

*Primary Examiner*—Robert Beatty
(74) *Attorney, Agent, or Firm*—Oblon, Spivak, McClelland, Maier & Neustadt, P.C.

(57) ABSTRACT

The present invention provides a belt fixing device which is aimed at solving problems such as offset, unsteady transportation of recording sheets, and the difficulty in shortening the rise time of a high-speed machine. Such a belt fixing device includes a heating roller, a fixing roller, a fixing belt, and a pressure roller. The heating roller and pressure roller have a heater therein. The fixing pressure in a first fixing process portion is set so low that no wrinkles will appear in a material onto which a toner image is to be fixed. The fixing pressure in a second fixing process portion is set so that desired fixing can be performed.

12 Claims, 17 Drawing Sheets

T 1 > T 1'

BELT FIXING DEVICE

TECHNICAL FIELD

The present invention relates to a belt fixing device for copying machines, printing machines, and facsimile machines.

BACKGROUND ART

In a conventional black-and-white image forming apparatus, such as a copying machine, a printing machine, and a facsimile machine, a latent image is formed on an image carrier, such as a photosensitive drum or a photosensitive belt, by a latent image forming unit. Such a latent image is developed by a developing unit to form a toner image, which is then transferred to a recording sheet and fixed by a fixing device.

In a color image forming apparatus, such as a color copying machine, a color printer, and a color facsimile machine, a plurality of latent images are formed on an image carrier, such as a photosensitive drum and a photosensitive belt. The latent images are developed with toners in different colors by a developing unit. The toner images in different colors are superimposed on each other to form a color image, which is then transferred to a material such as a recording sheet and fixed by a fixing device.

FIG. 6 shows a conventional thermal roller fixing device. In the thermal roller fixing device, a fixing roller 21 presses a pressure roller 22, and the fixing roller 21 is heated by a heater 23 disposed therein. A recording sheet as a material onto which a toner image is to be fixed is transported through the nip portion between the fixing roller 21 and the pressure roller 22. A toner image formed on the recording sheet is by the heat from the fixing roller 21 and the pressure from the pressure roller 22.

In the fixing device, oil is applied to the fixing roller to prevent offset. In a color image forming apparatus, it is necessary to use toners in different colors having a low viscosity to obtain a high-quality image having a high glossiness and a high light transmission rate. Therefore, oil is applied to the fixing roller to prevent offset.

Japanese Utility Model Application Laid-Open No. 62-60956 discloses a fixing device which has an endless-type fixing belt stretched over a fixing roller having a heat source therein and an idle roller having a diameter smaller than that of the fixing roller. The fixing belt has a high heat conductivity and a high separability, and is stretched over the fixing roller and the idle roller, with the separable surface facing outward. A pressure roller is brought into contact with the fixing belt in a point closer to the idle roller than the separation point of the fixing roller.

Japanese Patent Application Laid-Open No. 6-318001 discloses a fixing device which can produce clear fixed images without offset. The separability between the fixing belt and the toners is improved so that no or little oil is required. In this fixing device, an endless-type fixing belt having a release layer on the front surface of its belt main body is stretched between the surface-elastic fixing roller and the heating roller. A pressure roller presses the fixing roller from below via the fixing belt, thereby forming a nip portion between the fixing belt and the pressure roller. A recording medium support member disposed below the fixing belt between the heating roller and the nip portion forms a straight heating passage to the fixing belt. The heat capacity of the fixing belt is 0.002 to 0.025 cal/° C. per 1 $cm^2$.

In a fixing device disclosed in the above-mentioned Japanese Patent Application Laid-Open No. 6-318001 or Japanese Patent Application Laid-Open No. 8-137306, a toner image is atmosphere-preheated. The fixing effects and offset restrictions can be strengthened in a low-speed operation, but they cannot be improved in a high-speed operation. Moreover, to obtain effects from the preheat, the distance between the fixing belt B and the recording medium support member G needs to be narrowed, resulting in a problem of scratches in a non-fixed toner image.

In a fixing device disclosed in the above-mentioned Japanese Utility Model Application Laid-Open No. 62-60956 or Japanese Patent Application Laid-Open No. 4-273279, a fixing process is carried out to fix a toner image on a recording sheet via a belt, followed by a transporting process to transport the recording sheet by the belt and a removing process to remove the fixed toner image from the belt. The transportation of the recording sheet after the fixing process is unstable, often causing unevenness in glossiness and hot offset. Since the transfer sheet and the toners after passing through the nip portion is further subjected to the remained heat of the belt, the toners unduly melt and often cause offset. Also, due to the unsteady transportation of recording sheets, the temperature on the image surface of a recording sheet becomes partially uneven, which causes unevenness in glossiness.

A thermal roller fixing device comprising a thin roller and a glass roller to shorten the rise time is well known. Such a fixing device is disclosed in Japanese Patent Application Laid-Open Nos. 53-89744, 59-65867, 4-77917, and others. To shorten the rise time of this thermal roller fixing device, the heater has a large capacity, while the fixing roller has a low heat capacity. Because of this, the fixing roller is made thin and small in diameter, or the glass roller is employed to directly heat the surface of the fixing roller in an instant by radiated heat.

In the above thermal roller fixing device, however, the thin fixing roller having a small diameter and a low heat capacity is not strong enough. The low fixing pressure and the narrow nip width result in insufficient fixing. The thermal roller fixing device cannot provide desired fixing effects in a high-speed machine.

In a fixing device of a color image forming apparatus, the toners of each of colors overlapped on a recording material are melted enough to be fixed to the recording material. A low fixing pressure often causes a fault in fixing. Therefore, it is necessary to keep the fixing pressure high. Since the fixing roller cannot be made thin and small in diameter to maintain its strength, it is difficult to employ a thin roller and a glass roller to shorten the rise time in the conventional thermal roller fixing device.

Also, to obtain a high-quality image having a high glossiness and a high light transmission rate in a color image forming apparatus, it is necessary to use toners in different colors having a low viscosity. Therefore, oil must be applied to the fixing roller to prevent offset.

In a fixing device disclosed in Japanese Patent Application Laid-Open No. 4-324476, two heaters are disposed on the side of the front surface of a recording sheet, and they are switched depending on the copying mode. In this case, the recording sheet receives heat only on its front surface, and offset is not efficiently prevented. In this fixing device, a separation claw is also necessary to separate a recording sheet from the fixing roller and the pressure roller. In a fixing device disclosed in Japanese Patent Application Laid-Open No. 62-23260, a curl removing roller is necessary to prevent a recording sheet from curling.

DISCLOSURE OF THE INVENTION

An object of the present invention is to provide a fixing device in which excellent material transportation and fixing can be performed, and wrinkles and scratches in a non-fixed image can be efficiently prevented.

Another object of the present invention is to provide a fixing device which performs stable fixing even in a high-speed machine or in a color image forming apparatus.

Yet another object of the present invention is to provide a fixing device which can shorten the rise time and reduce the energy consumption.

Still another object of the present invention is to provide a fixing device which performs excellent fixing regardless of the type of material onto which an image is to be fixed.

Another object of the present invention is to provides a fixing device which performs excellent fixing regardless of the image formation mode.

Yet another object of the present invention is to provide a belt fixing device which requires no separation claw, and prevents a material from curling without a curl removing roller.

To achieve the above objects, the present invention provides a belt fixing device which comprises a fixing roller, a heating roller, an endless-type fixing belt stretched over the heating roller and the fixing roller, a pressure roller facing the fixing roller via the fixing belt. This belt fixing device fixes a toner image formed on a material to be transported between the pressure roller and the fixing belt. A heater for heating the fixing belt is disposed in either or both of the pressure roller and the heating roller. The fixing pressure in a first fixing process portion where the pressure roller is in contact with the fixing belt without pressing the fixing roller via the fixing belt is set low enough to prevent wrinkles in the material. The fixing pressure in a second fixing process portion where the pressure roller presses the fixing roller via the fixing belt is set so that desired fixing can be performed.

In accordance with the above invention, excellent transportation of the material and fixing on the material can be performed, and stable fixing effects can be obtained even in the fixing device of a high-speed machine or a color image forming apparatus.

In this invention, the fixing pressure on the material in the first fixing process portion may be 1 kgf/cm$^2$ or lower, and the fixing pressure on the material in the second fixing process portion may be higher than the fixing pressure in the first fixing process portion. In accordance with this invention, excellent transportation of the material and fixing on the material are performed, and stable fixing effects can be obtained even in the fixing device of a high-speed device or a color image forming apparatus.

In accordance with another aspect of the present invention, a belt fixing device comprises a fixing roller, a heating roller, an endless-type fixing belt stretched over the heating roller and the fixing roller, and a pressure roller facing the fixing roller via the fixing belt. This belt fixing device fixes a toner image formed on a material to be transported between the pressure roller and the fixing belt. A heater for heating the fixing belt is disposed inside the heating roller. The heating roller has a low heat capacity. With this belt fixing device, the rise time can be shortened, and the energy consumption can be reduced.

In accordance with yet another aspect of the present invention, a belt fixing device comprises a fixing roller, a heating roller, an endless-type fixing belt stretched over the heating roller and the fixing roller, and a pressure roller facing the fixing roller via the fixing belt. This belt fixing device fixes a toner image formed on a material to be transported between the pressure roller and the fixing belt. A heater for heating the fixing belt is disposed inside the heating roller. The heating roller is made of a metallic material having a low heat capacity. The heating roller is 20 mm to 40 mm in diameter, and 0.3 mm to 2.0 mm in thickness. With this belt fixing device, the rise time can be shortened, and the energy consumption can be reduced.

In accordance with still another aspect of the present invention, a belt fixing device comprises a fixing roller, a heating roller, an endless-type fixing belt stretched over the heating roller and the fixing roller, and a pressure roller facing the fixing roller via the fixing belt. This belt fixing device fixes a toner image formed on a material to be transported between the pressure roller and the fixing belt. A heater for heating the fixing belt is disposed inside the heating roller. The heating roller is light transmittable, and a layer having a high radiation absorption rate is formed either on the inner periphery of the fixing belt or on the outer periphery of the heating roller. With this belt fixing device, the rise time can be shortened, and the energy consumption can be reduced.

In accordance with another aspect of the present invention, a belt fixing device comprises a fixing roller, an endless-type fixing belt stretched over the fixing roller, a heating unit for heating the fixing belt, a pressure roller facing the fixing roller via the fixing belt, and a fixing belt heater for heating either or both of the pressure roller and the heating unit. The fixing pressure in a first fixing process portion, where the pressure roller is in contact with the fixing belt without pressing fixing roller in the direction of transporting a material onto which an image is to be fixed, is set low enough to prevent wrinkles in the material. The fixing pressure in a second fixing portion, where the pressure roller presses the fixing roller via the fixing belt, set so that desired fixing can be performed. The distance between the point where the fixing belt separates from the spot heated by the heating unit and the point where the fixing belt is first brought into contact with the pressure roller is 20 mm or shorter. With this belt fixing device, scratches in a non-fixed image can be efficiently prevented.

In accordance with yet another aspect of the present invention, a belt fixing device comprises a fixing roller, a heating roller, an endless-type fixing belt stretched over the heating roller and the fixing roller, a pressure roller facing the fixing roller via the fixing belt, and a heater for heating the fixing belt disposed in either or both of the pressure roller and the heating roller. The fixing pressure in a first fixing process portion, where the pressure roller presses the heating roller via the fixing belt without pressing the fixing roller in a direction of transporting a material onto which an image is to be fixed, is set at 0.5 kgf/cm$^2$ or lower so as to prevent wrinkles in the material. The fixing pressure in a second fixing process portion, where the pressure roller presses the fixing roller via the fixing belt, is set so that desired fixing can be performed. With this belt fixing device, wrinkles in the material and scratches in a non-fixed image can be efficiently prevented.

In accordance with still another aspect of the present invention, a belt fixing device comprises a fixing roller, a heating roller, an endless-type fixing belt stretched over the heating roller and the fixing roller, a pressure roller facing the fixing roller via the fixing belt, and a heater for heating the fixing belt disposed in either or both of the pressure roller and the heating roller. The fixing pressure in a first fixing process portion, where the pressure roller is in contact with the fixing belt without pressing the fixing roller in the direction of transporting a material onto which an image is to be fixed, is set so low that no wrinkles appear in the material. The fixing pressure in a second fixing process portion, where the pressure roller presses the fixing roller via the fixing belt, is set so that desired fixing can be performed. In this belt fixing device, a guide member is provided to the inner side of the fixing belt in the vicinity of the position, where the fixing belt heated by the heating roller is first brought into contact with the pressure roller. The heating roller is arranged so that the fixing belt stays away from the material having a non-fixed toner image thereon, while the fixing belt is situated between the point where the fixing belt separates from the heating roller and the point where the fixing belt is first brought into contact with the pressure roller. With this belt fixing device, no scratches will appear in a non-fixed image.

In accordance with another aspect of the present invention, a belt fixing device comprises a fixing roller, a heating roller, an endless-type fixing belt stretched over the heating roller and the fixing roller, a pressure roller facing the fixing roller via the fixing belt, a heater for heating the fixing belt disposed in either or both of the pressure roller and the heating roller, and a guide member disposed on the inner side of the fixing belt in the vicinity of the spot, where the fixing belt is first brought into contact with pressure roller in the direction of a material onto which an image is to be fixed. The heating roller is arranged so that the fixing belt stays away from the material having a non-fixed toner image thereon between the point, where the fixing belt separates from the heating roller, and the point, where the fixing belt is first brought into contact with the pressure roller. The fixing pressure in a first fixing process portion where the pressure roller presses the guide member via the fixing belt is set at 0.5 $kgf/cm^2$ or lower so as to prevent wrinkles in the material. The fixing pressure in a second fixing process portion where the pressure roller presses the fixing roller via the fixing belt is set so that desired fixing can be performed. With this belt fixing device, wrinkles in the material and scratches in a non-fixed image can be efficiently prevented.

In accordance with yet another aspect of the present invention, a belt fixing device comprises a fixing roller, a heating roller, an endless-type fixing belt stretched over the heating roller and the fixing roller, a pressure roller facing the fixing roller via the fixing belt, and two heaters disposed inside the heating roller and the pressure roller, respectively. The fixing pressure in a first fixing process portion where the pressure roller is in contact with the fixing belt without pressing the fixing roller is set low enough to prevent wrinkles in a material onto which an image is to be fixed. The fixing pressure in a second fixing process portion where the pressure roller presses the fixing roller via the fixing belt is set so that desired fixing can be performed. The temperatures of the fixing belt and the pressure roller are set so that the temperature difference between the fixing belt and the pressure roller is 40° C. or smaller during the rotating operation. With this belt fixing device, uneven glossiness can be prevented in an image formed on the material.

In accordance with still another aspect of the present invention, a belt fixing device comprises a fixing roller, a heating roller, an endless-type fixing belt stretched over the heating roller and the fixing roller, a pressure roller facing the fixing roller via the fixing belt, and two heaters disposed inside the heating roller and the pressure roller, respectively. The fixing pressure in a first fixing process portion where the pressure roller is in contact with the fixing belt without pressing the fixing roller is set low enough to prevent wrinkles in a material onto which an image is to be fixed. The fixing pressure in a second fixing process portion where the pressure roller presses the fixing roller via the fixing belt is set so that desired fixing can be performed. This belt fixing device further comprises a switch unit which switches on either of the two heaters when a normal paper mode is selected to use normal paper as the material, and which switches on both heaters when a special paper mode is selected to use special paper as the material. With this belt fixing device, excellent fixing effects can be obtained regardless of the type of material.

In accordance with another aspect of the present invention, a belt fixing device comprises a fixing roller, a heating roller, an endless-type fixing belt stretched over the heating roller and the fixing roller, a pressure roller facing the fixing roller via the fixing belt, and two heaters disposed inside the heating roller and the pressure roller, respectively. The fixing pressure in a first fixing process portion where the pressure roller is in contact with the fixing belt without pressing the fixing roller is set low enough to prevent wrinkles in a material onto which an image is to be fixed. The fixing pressure in a second fixing process portion where the pressure roller presses the fixing roller via the fixing belt is set so that desired fixing can be performed. When a one-side image formation mode is selected, the temperature of the fixing belt is set lower than the temperature of the pressure roller during the rotating operation. When a two-side image formation mode is selected, the temperature of the fixing belt is set higher than the temperature of the pressure roller during the rotating operation. With this belt fixing device, uneven glossiness can be prevented in an image on the material, and excellent fixing effects can be obtained regardless of the image formation mode.

In this belt fixing device, when the two-side image formation mode is selected, the temperature of the fixing belt is set higher than the temperature of the pressure roller during the rotating operation so that the temperature difference between the fixing belt and the pressure roller is 30° C. or greater. With this belt fixing device, excellent fixing effects can be obtained regardless of the image formation mode.

In accordance with another aspect of the present invention, a belt fixing device comprises a fixing roller, a heating roller, an endless-type fixing belt stretched over the heating roller and the fixing roller, a pressure roller facing the fixing roller via the fixing belt, and a heater disposed in either or both of the heating roller and the pressure roller. The fixing pressure in a first fixing process portion where the pressure roller is in contact with the fixing belt without pressing the fixing roller is set low enough to prevent wrinkles in a material onto which an image is to be fixed. The fixing pressure in a second fixing process portion where the pressure roller presses the fixing roller via the fixing belt is set so that desired fixing can be performed. In this belt fixing device, the surface hardness of the fixing roller is greater than that of the pressure roller. The nip in the first fixing process portion has a convex shape, while the nip in the second fixing process portion has a concave shape. With this belt fixing device, a separation claw is unnecessary, and the material can be prevented from curling without a curl removing roller.

In accordance with yet another aspect of the present invention, a belt fixing device comprises a fixing roller, a heating roller, an endless-type fixing belt stretched over the heating roller and the fixing roller, a pressure roller facing the fixing roller via the fixing belt, and two heaters disposed in either or both of the heating roller and the pressure roller. The fixing pressure in a first fixing process portion where the pressure roller is in contact with the fixing belt without pressing the fixing roller is set low enough to prevent wrinkles in a material onto which an image is to be fixed. The fixing pressure in a second fixing process portion where the pressure roller presses the fixing roller via the fixing belt is set so that desired fixing can be performed. In this belt fixing device, the surface hardness of the fixing roller is substantially the same as the surface hardness of the pressure roller, and the nip in the second fixing process portion is substantially straight. With this belt fixing device, a separation claw is unnecessary.

The above and other objects and features of the present invention will become apparent from the following description taken in conjunction with the accompanying drawings.

BEST MODE FOR CARRYING OUT THE INVENTION

Figure 1:
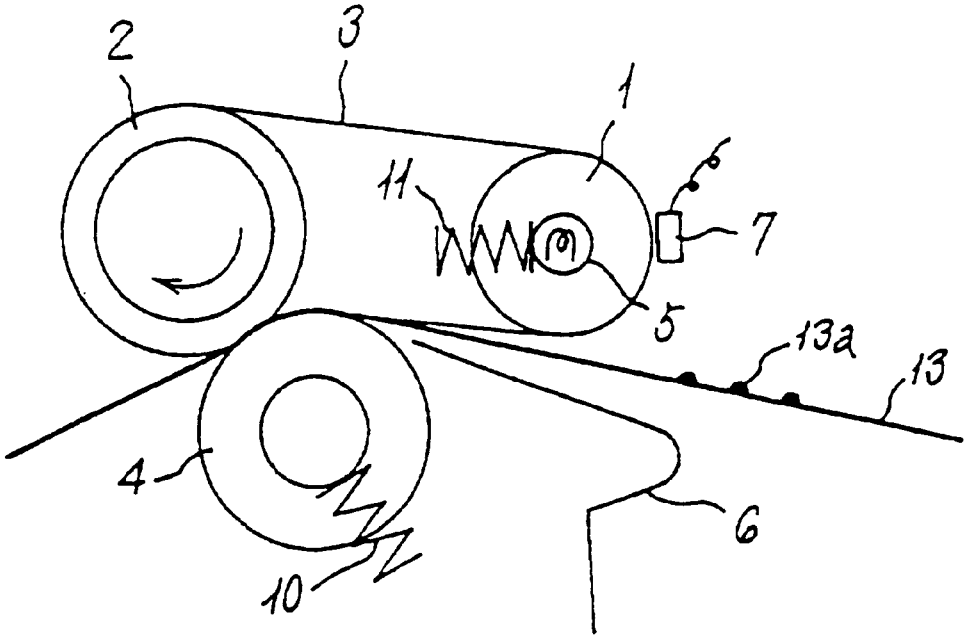
FIG. 1 is a schematic view illustrating a first embodiment of the present invention.
Figure 2:
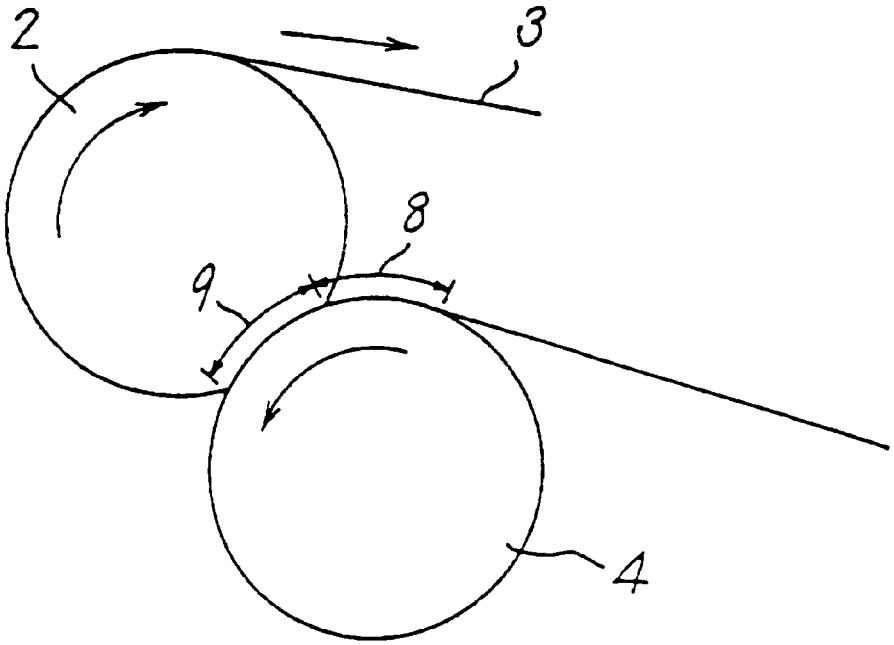
FIG. 2 is a partially enlarged view of the structure of FIG. 1.

FIG. 1 illustrates a first embodiment of the present invention, and FIG. 2 is a partially enlarged view of the first embodiment. In this embodiment, hot offset is prevented, and the rise time is shortened, so that no oil will be required in a fixing device for a color image forming apparatus. FIGS. 1 and 2 show a heating roller 1, a fixing roller 2, an endless-type fixing belt 3, a pressure roller 4, a fixing belt heater 5, an inlet guide plate 6, a temperature detecting unit 7 including a thermistor, a first fixing process portion 8 for performing a first fixing process, a second fixing process portion 9 for performing a second fixing process, a pressure unit 10 including a pressure spring, a tension providing unit 11 including a tension spring, and a recording sheet 13 carrying non-fixed toner 13*a*.

The fixing belt 3 is attached to the heating roller 1 and the fixing roller 2 by predetermined tension. The pressure roller 4 faces to the fixing roller 4 via the fixing belt 3. The pressure roller 4 presses the fixing roller 2 in the second fixing process portion 9 via the fixing belt 3, while it does not press the fixing roller 2 in the first fixing process portion 8 and is brought into contact with the fixing roller 2.

The heating roller 1, which contains the heater 5 inside, is formed by a thin metal pipe (made of aluminum, iron, lead, or stainless steel, for instance) of small diameter, so that the rise time of the device can be shortened. Accordingly, the heat capacity of the heating roller 1 is low. The heater 5 heats the fixing belt 3 via the heating roller 1. The thermistor 7 detects the surface temperature of the portion on the fixing belt 3 heated by the heating roller 1. The surface temperature of the fixing belt 3 is controlled by a temperature control unit (not shown) which maintains the heater 5 at a predetermined temperature based on a temperature detection signal from the thermistor 7.

The heating roller 1, the fixing roller 2, the fixing belt 3, and the pressure roller 4 are rotated by a drive (not shown). A recording sheet as a material onto which a toner image is to be fixed is transported between the fixing belt 3 and the pressure roller 4, and a toner image formed on the recording sheet is heated and fixed to the recording sheet by the fixing belt 3. The fixing pressure in the first fixing process portion 8 (i.e., the pressure between the fixing belt 3 and the pressure roller 4) is set so low that no wrinkles will appear on the recording sheet. The fixing pressure in the second fixing process portion 9 (i.e., the contact pressure between the fixing belt 3 and the pressure roller 4) is set so as to obtain desired fixing ability.

The heating roller 1 is movable, and provides tension to the fixing belt 3 by the pressure spring 11. The pressure roller 4 is pressed by the pressure spring 10, and in turn presses the fixing roller 2 via the fixing belt 3. The fixing pressure in the first fixing process is set by adjusting the tension of the fixing belt 3 by the tension spring 11. The fixing pressure in the second fixing process is set by the pressure spring 10. Also, the pressure spring 10 may press the fixing roller 2 so that the pressure roller 4 will press the fixing roller 2 via the fixing belt 3.

In this embodiment, since the heater 5 heats the fixing belt 3 via the heating roller 1 having a low capacity, quick rising is possible. A preferable temperature for fixing can also be maintained, because the fixing process consisting of the first and second fixing processes is long enough (the nip width is so great that the nip time is 50 ms to 200 ms, which is long enough), and also because the fixing belt 3 has excellent self-cooling action (the surface of the fixing belt 3 cools off in the fixing process due to the lack of any heating source on the non-fixing image surface sides of the fixing process portions 8 and 9 of the fixing belt 3). Thus, there can be more restrictions on offset in this embodiment.

The fixing pressure in the first fixing process on the recording sheet feeding side is set low enough, for instance, at 1 kgf/cm$^2$ or lower, or more preferably at 0.5 kgf/cm$^2$ or lower. By doing so, the recording sheet is smoothly fed into the nip portion between the fixing belt 3 and the pressure roller 4, and fewer wrinkles appear on the recording sheet than in the prior art (in a conventional thermal roller fixing device).

Figure 3:
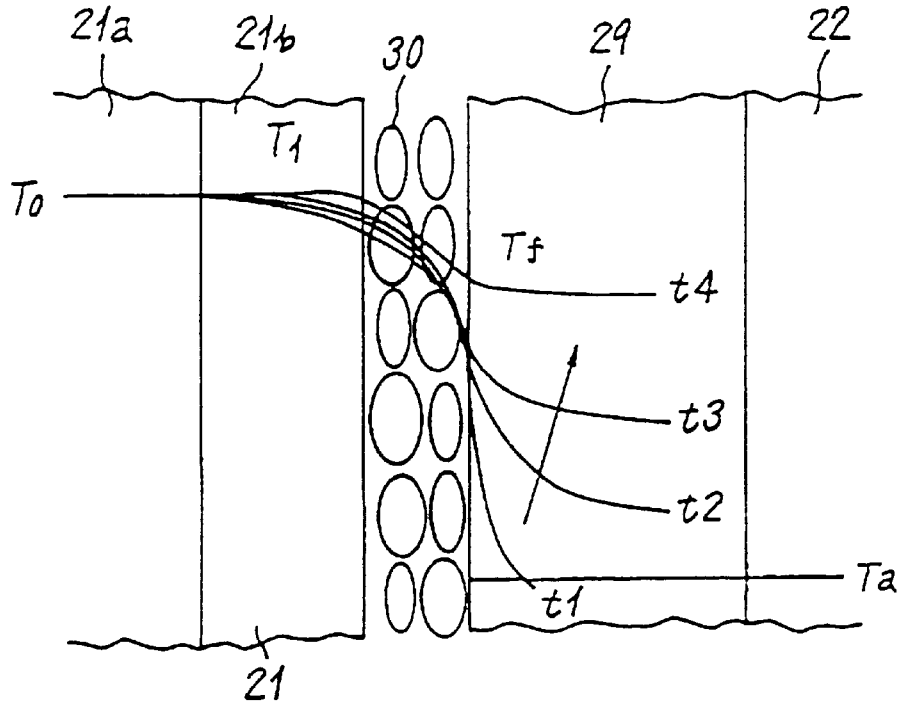
FIG. 3 shows the unsteady temperature distribution in each layer that changes with time, in the case where a recording sheet is fed into the fixing nip portion so that the non-fixed toner on the recording sheet is brought into contact with the fixing roller in a conventional thermal roller fixing device.

In the first embodiment, a preferable temperature for fixing is maintained, thereby providing more allowance for offset. Referring now to FIG. 3 illustrating a thermal roller fixing device, a heater is disposed inside a fixing roller 21, and the fixing roller 21 comprises a metal core 21*a* and a silicone rubber layer 21*b*. FIG. 3 shows the unsteady temperature distribution state of each layer, which changes with time between when a recording sheet 29 is fed into the fixing nip portion of the fixing roller 21 and a pressure roller 22, and when the non-fixed toner 30 on the recording sheet 29 is brought into contact with the fixing roller 21. The unsteady temperature distribution state changes during the nip time for transporting the recording sheet through the nip portion.

Assuming that the internal heater provides a predetermined amount of heat for the fixing roller 21, the fixing roller 21 is at first maintained at a steady temperature $T_0$. The temperature distribution inside each layer right after the recording sheet 29 is fed into the fixing nip portion is indicated by t1, and it changes with time as indicated by t2 and t3. Here, the boundary surface between the silicone rubber layer 21*b* and the non-fixed toner 30 on the recording sheet 29 is maintained at a steady temperature T1 (equivalent to the upper surface temperature of the toner 30).

As time passes, heat propagates inside the toner 30, and the boundary temperature Tf between the toner 30 and the recording sheet 29 (equivalent to the lower surface temperature of the toner 30) gradually rises. When the nip time is long enough to make the temperature distribution between the toner 30 and the recording sheet 29 steady, the temperature distribution becomes as indicated by t4. The boundary temperature T1 between the silicone rubber layer 21*b* and the non-fixed toner 30 on the recording sheet 29 gradually rises, and so does the boundary temperature Tf.

Figure 7A:
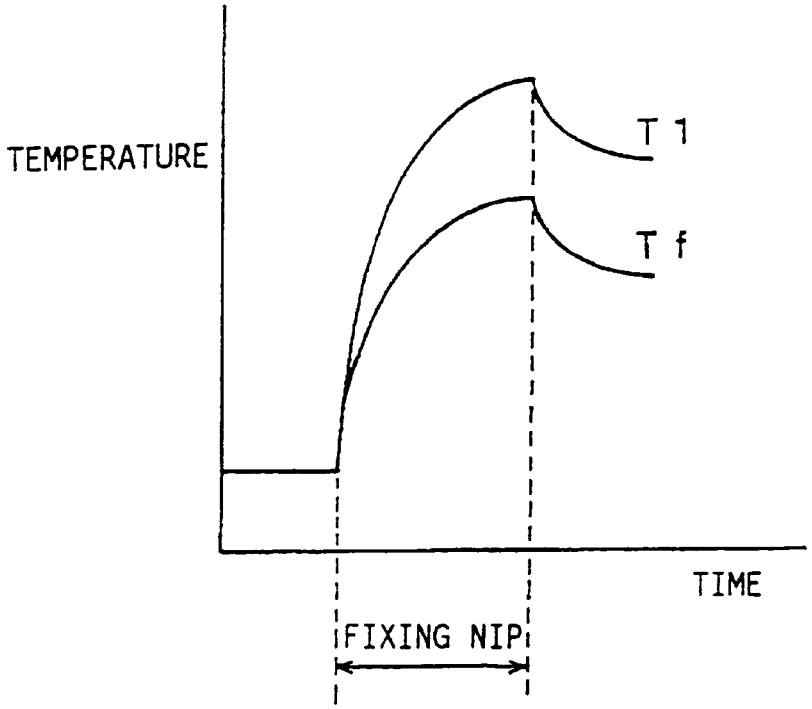
FIG. 7(*a*) shows graphs of a toner temperature variation of a conventional belt fixing device, and FIG. 7(*b*) shows graphs of a toner temperature variation of the belt fixing device of the first embodiment of the present invention.
Figure 7B:
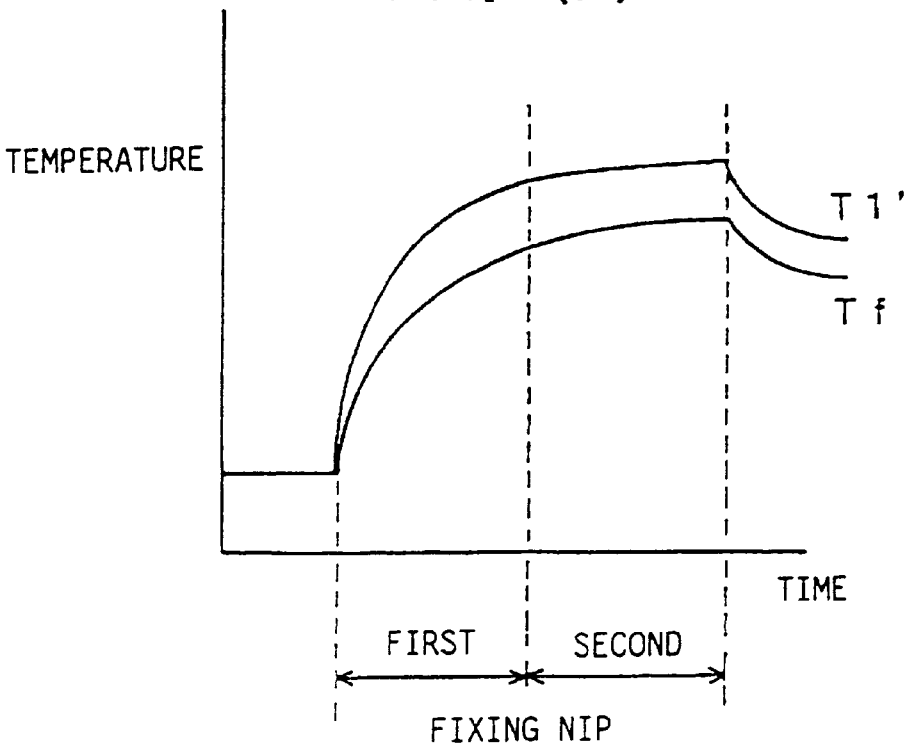

In the belt fixing device of this embodiment, the fixing belt 3 has a self-cooling action. Since no heat source exists on the non-fixed image surface side of the fixing nip portion of the fixing belt 3 and the pressure roller 4, the recording sheet deprives the fixing belt 3 of heat. As a result, the temperature of the surfaces of the fixing belt 3 drops with time. Although the boundary temperature Tf rises with time, a rise in the boundary temperature T1 is smaller than in the thermal roller fixing device having a heat source. In a conventional thermal roller fixing device, when the toner on a recording sheet passes through the fixing nip portion in a short period of time, the boundary temperatures Tf and T1 change as shown in FIG. 7(*a*). In the first embodiment of the present invention, however, when the toner on a recording sheet passes through the long fixing process portion consisting of the first fixing process portion 8 and the second fixing process portion 9, the boundary temperatures Tf and T1 (the boundary temperature between the fixing belt 3 and the non-fixed toner on the recording sheet) change as shown in FIG. 7(*b*).

The temperature of the fixing roller 21 at the time of hot offset occurrence is indicated by T01, while the lowest possible temperature for fixing is indicated by T02. Hot offset occurs when the adhesive strength on the interface between the fixing roller 21 and the toner 30 becomes stronger than the cohesive force caused by a change in the viscoelasticity of the toner 30 at the time of melting. In other words, the interface temperature T1 has an influence on whether hot offset occurs or not.

On the other hand, fixing is done when the adhesive strength on the interface between the recording sheet 29 and the toner 30 becomes stronger than the cohesive force caused by a change in the viscoelasticity of the toner at the time of melting. In other words, the interface temperature Tf has an influence on whether hot offset occurs or not. A preferable temperature for fixing is determined from the interface temperature T1 when the temperature T0 is T01, and from the interface temperature Tf when the temperature T0 is T02.

Figure 4:
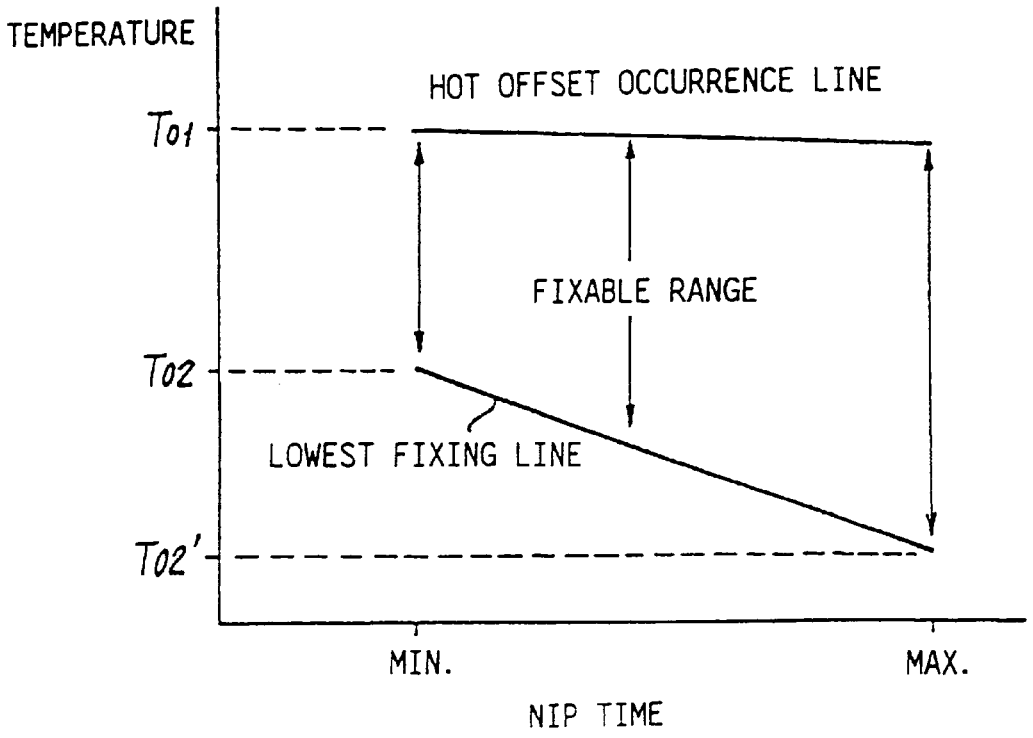
FIG. 4 is a diagram showing the width of the temperature range for fixing in the first embodiment of the present invention.
Figure 5:
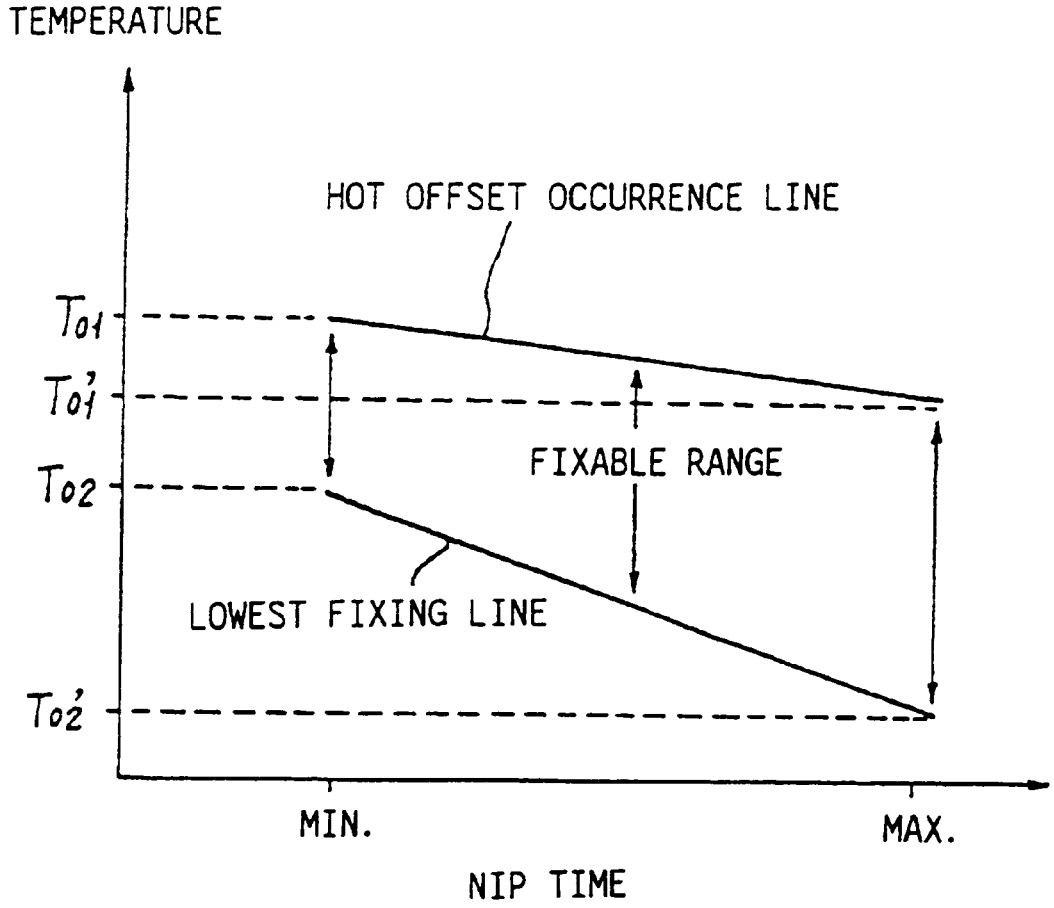
FIG. 5 is a diagram showing the width of the temperature range for fixing in the thermal roller fixing device.
Figure 6:
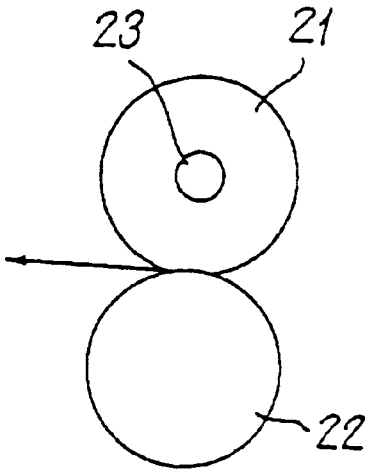
FIG. 6 is a schematic view of the conventional thermal roller fixing device.

FIG. 4 graphically shows the range of the temperature for fixing in the first embodiment, and FIG. 5 graphically shows the range of the temperature for fixing in a conventional thermal roller fixing device. In FIGS. 4 and 5, a hot offset occurrence line indicates the temperature that causes hot offset. Here, it is also possible to assume that whether the toner image is fixed or hot offset occurs depends on the time (nip time) during which the temperature of the toners is higher than the softening point. However, calculating a drop in cohesive force due to the viscoelasticity of the toners is very difficult. The effects of the first embodiment in practical use have to be examined through an experiment.

Figure 8:
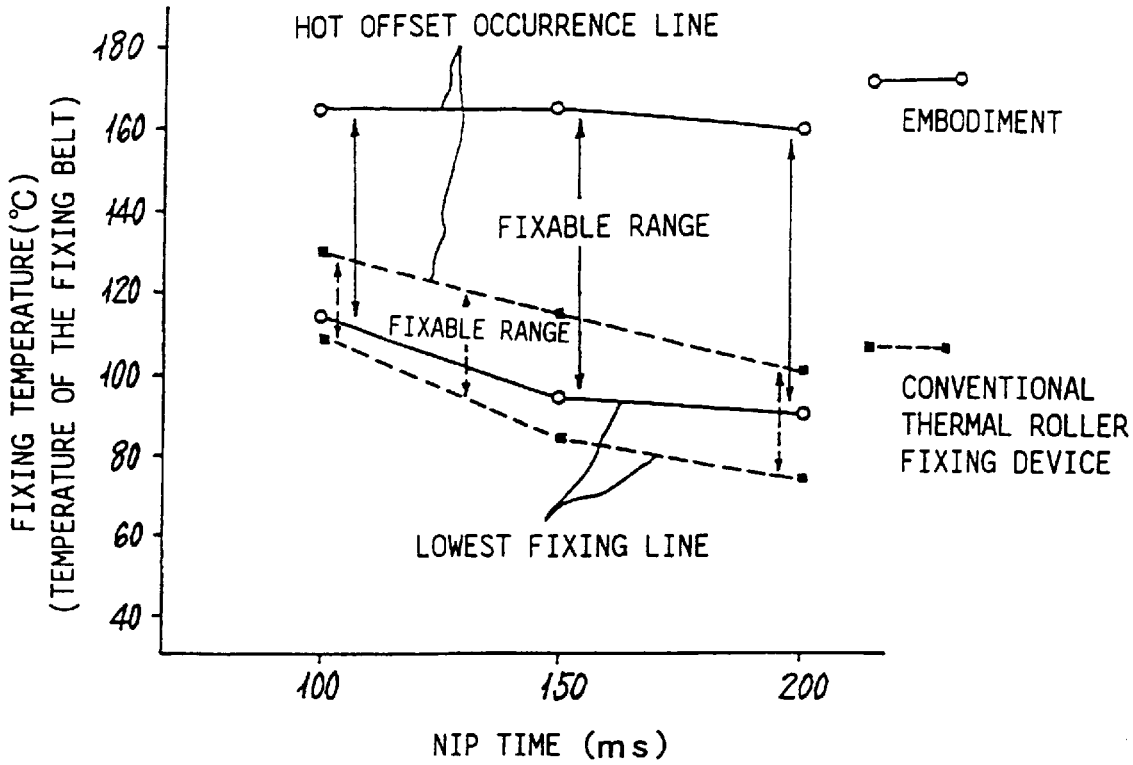
FIG. 8 presents graphs showing the results of an examination of the relationship between the elapsed time and the fixing temperature in the case where a recording sheet is fed into the fixing nip portion so that the non-fixed toner on the recording sheet is brought into contact with the fixing roller both in the conventional thermal roller fixing device and the first embodiment of the present invention.

FIG. 8 shows an example of the results of such an experiment. There is a strong correlation between the range of temperature for fixing shown in FIG. 8 and the ranges of temperature for fixing shown in FIGS. 4 and 5. In view of this, hot offset occurrence depends on the interface temperature between the toner on the transfer paper and the fixing roller 21 or the fixing belt 3, and the lowest possible temperature for fixing depends on the interface temperature of the toner on the recording sheet.

As the nip time becomes longer, the lowest possible temperature for fixing drops at the same rate in both the first embodiment and in the conventional thermal roller fixing device. In the first embodiment, the hot offset occurrence temperature does not dramatically drop, as the nip time becomes longer. Fixing is done in the fixing process with the heat capacity given from the heating roller to the fixing belt in advance in the first embodiment. Accordingly, the hot offset occurrence line does not dramatically drop, even if the nip time is long.

In the thermal roller fixing device, however, the hot offset occurrence temperature is low and dramatically drops as the nip time becomes longer. As a whole, the temperature range for fixing is narrower. Thus, the first embodiment is proved to be more effective than the conventional thermal roller fixing device. In the thermal roller fixing device, the nip width (nip time) cannot be great, and therefore it is necessary to heat a toner image on the recording sheet to a high temperature so as to fix the toner image. Because of this, the temperature of the toner rises too rapidly, and the temperature gradient between Tf and T1 becomes large. In other words, T1 is higher than Tf.

Figure 9:
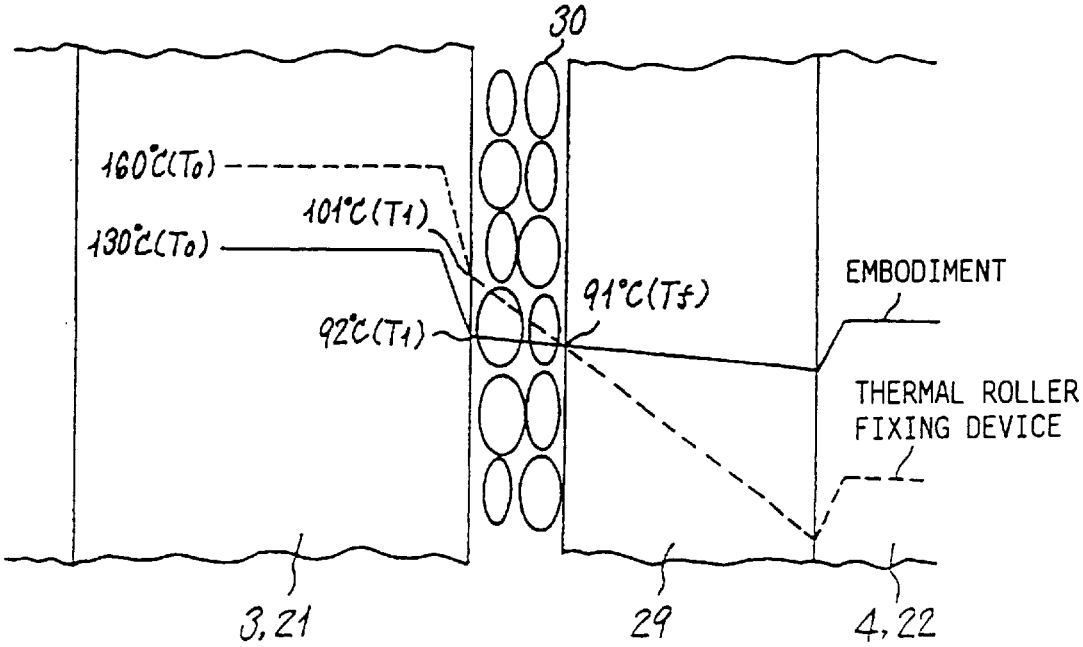
FIG. 9 shows the measured results of the temperature distributions in a cross section of the fixing nip portion when the first embodiment of the present invention and the conventional thermal roller fixing device have the same fixing properties.

Next, the hot offset and fixing properties of the first embodiment are examined using oil-free toner. FIG. 9 shows the temperature distributions in a cross section of the fixing nip portion in the case where the first embodiment and the conventional thermal roller fixing device have the same fixing properties. The fixing temperature is 130° C. at one spot of the first embodiment, while it is 160° C. at the corresponding spot in the conventional thermal roller fixing device. Here, the surface temperature of the recording sheet at the fixing nip portion is 91° C.

Based on the above results, the interface temperature between the toner 30 on the recording sheet 29 and the fixing roller 21 or the fixing belt 3 is calculated. It is 92° C. in the first embodiment, and 101° C. in the conventional thermal roller fixing device. The toner viscosity increases, as the interface temperature rises. This should be disadvantageous in preventing hot offset. Thus, it is verified that the conventional thermal roller fixing device allows more hot offset than the first embodiment.

Figure 10:
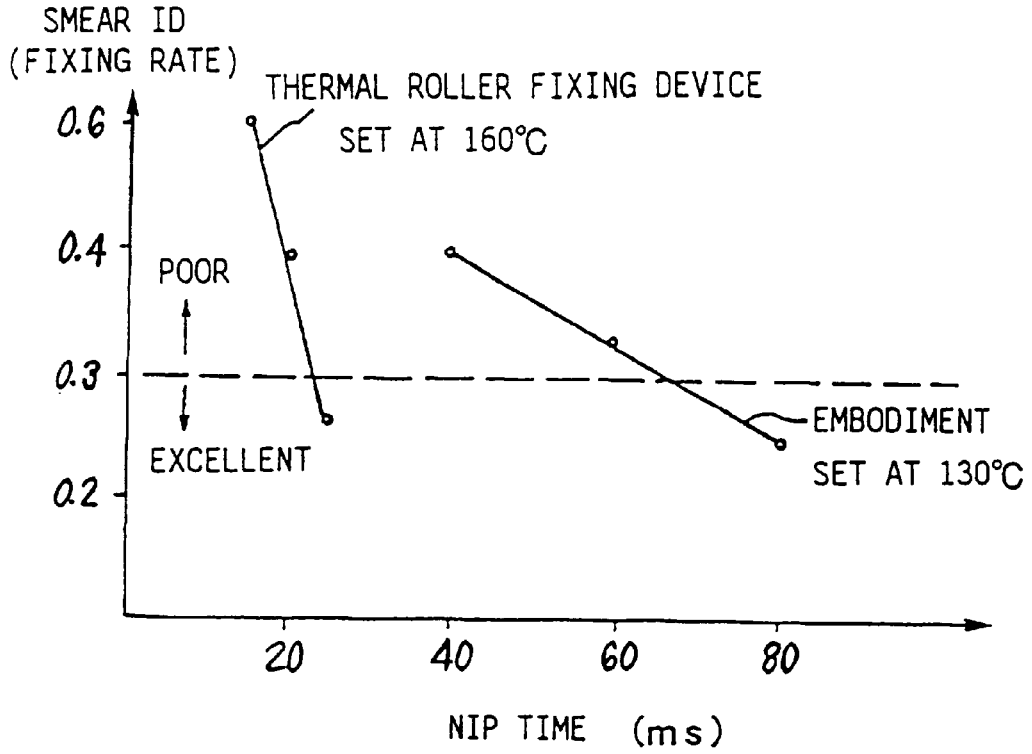
FIG. 10 presents graphs showing the measured results of the relationship between the nip time variation and the fixing ratio when the first embodiment of the present invention and the conventional thermal roller fixing device have the same fixing properties.

FIG. 10 shows the relationship between the nip time and the fixing rate in the above fixing conditions. According to the graphs in FIG. 10, the variation of the fixing rate is smaller in the first embodiment than in the conventional-thermal roller fixing device, despite the variation of the nip time (i.e., despite the variations in fixing pressure, roller swelling, rubber hardness, and others). This proves that the first embodiment has more stable fixing properties.

As described above, the long enough fixing process portion and the self-cooling action of the fixing belt 3 (an action which cools the surface of the fixing belt 3 in the fixing process due to the lack of any heat source on the non-fixed image surface sides of the fixing process portions 8 and 9) allow the first embodiment a wider range of temperature for fixing. This places more restrictions on hot offset. Also, the first embodiment will not be affected by a variation in the width of the fixing nip portion, thereby keeping stable fixing ability.

Figure 16A:
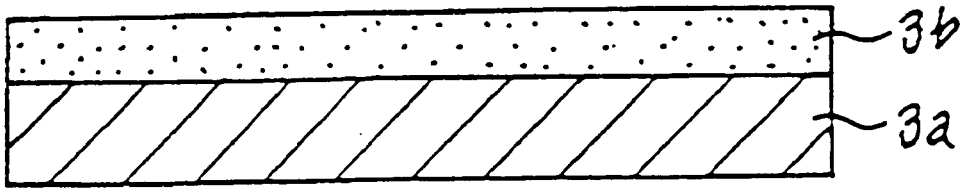
FIGS. 16(*a*) to 16(*c*) are sectional views of the fixing belt of the first embodiment of the present invention.
Figure 16B:
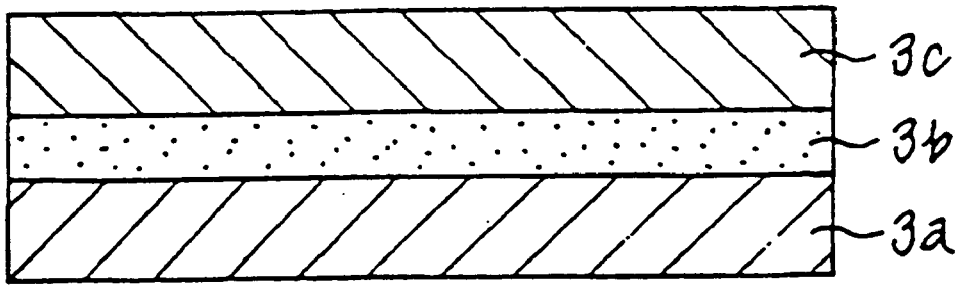
Figure 16C:
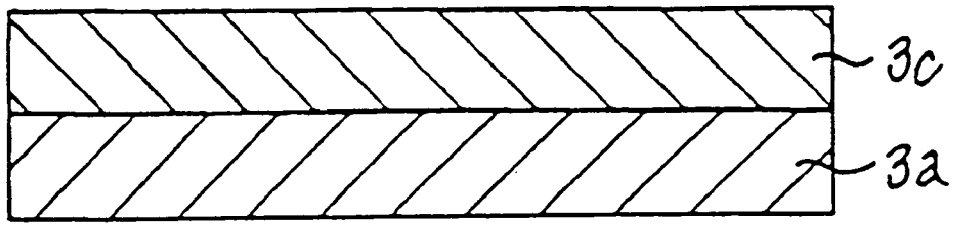

The fixing belt 3 of the first embodiment has only a low heat capacity. As shown in FIG. 16(*a*), a separate layer 3*b* is formed on a substrate 3*a*. The fixing belt 3 has a desirable heat responsibility, having the thin separate layer 3*b* made of silicone rubber (preferably 50 to 300 $\mu$m in thickness) or of fluororesin (preferably 10 to 50 $\mu$m in thickness) on the thin substrate 3*a* (preferably 30 to 150 $\mu$m in thickness in the case of nickel or polyimide). As shown in FIG. 16(*b*), the fixing belt 3 may have a fluororesin layer 3*c* on the separate layer 3*b*. As shown in FIG. 16(*c*), the fixing belt 3 may also have the fluororesin layer 3*c* on the substrate 3*a*.

The fixing belt 3 is preferably heated instantly by the heating roller 1 at the heating spot, and the surface of it is then cooled instantly at the fixing nip portion. However, the fixing belt 3 should be designed to have a heat capacity large enough to melt and fix the toner. Thus, the thickness of the fixing belt 3 is in such a range that fulfills the above two conditions.

Next, the transportation of recording sheet (especially how wrinkles are prevented during the transportation) will be explained. In the first embodiment, the fixing nip portion (consisting of the first and second fixing process portions) is long enough. If there is a great restriction on the width in the fixing nip portion, more wrinkles (vertically striped wrinkles, earthworm-like wrinkles, or corrugate wrinkles) will appear compared with the conventional thermal roller fixing device.

In view of this, the fixing belt 3 and an inlet guide plate 6 are arranged in the first fixing process portion 8, so that a recording sheet can be smoothly transported between the fixing belt 3 and the pressure roller 4 rotating at the same speed as the recording sheet. Here, the fixing pressure is set so low that no wrinkles will appear due to a force acting unevenly on the recording sheet.

In the second fixing process portion 9 on the outlet side formed by the pressure roller 4 pressing the fixing roller 2 via the fixing belt 3, the pressure spring 10 provides a fixing pressure great enough to prevent faulty fixing. The fixing nip portion including the fixing process portions 8 and 9 is long enough to perform excellent fixing and to secure smooth transportation of a recording sheet.

As described so far, the first embodiment is a belt fixing device which comprises the fixing roller 2, the heating roller 1, the endless-type fixing belt 3 stretched over the heating roller 1 and the fixing roller 2, and the pressure roller 4 facing the fixing roller 2 via the fixing belt 3. This belt fixing device 3 fixes a toner image formed on a recording sheet to be transported between the pressure roller 4 and the fixing belt 3. The heating roller contains the heater 5 for heating the fixing belt 3. The pressure roller 4 is in contact with the fixing belt 3 without putting pressure on the fixing roller 2 via the fixing belt 3, so that the fixing pressure in the first fixing process portion 8 can be set low enough to prevent wrinkles on the recording sheet. On the other hand, the pressure roller 4 presses the fixing roller 2 via the fixing belt, so that the fixing pressure can be desirable in the second fixing process portion 9. The fixing process is long enough, and the fixing belt has self-cooling action. Thus, a desirable range of temperature can be obtained so as to put more restrictions on offset. Also, the fixing pressure in the first fixing process portion 8 is set low enough to prevent wrinkles on the recording sheet. Thus, smooth transportation and excellent fixing of the recording sheet can be achieved, and stable fixing ability can be assured in a fixing device for high-speed copying machines or color image forming apparatus.

Although the heater 5 for heating the fixing belt is provided inside the heating roller 1, the same effect can be achieved by disposing the heater 5 in the pressure roller 4 or by disposing the heater 5 in both the heating roller 1 and the pressure roller 4.

Figure 15:
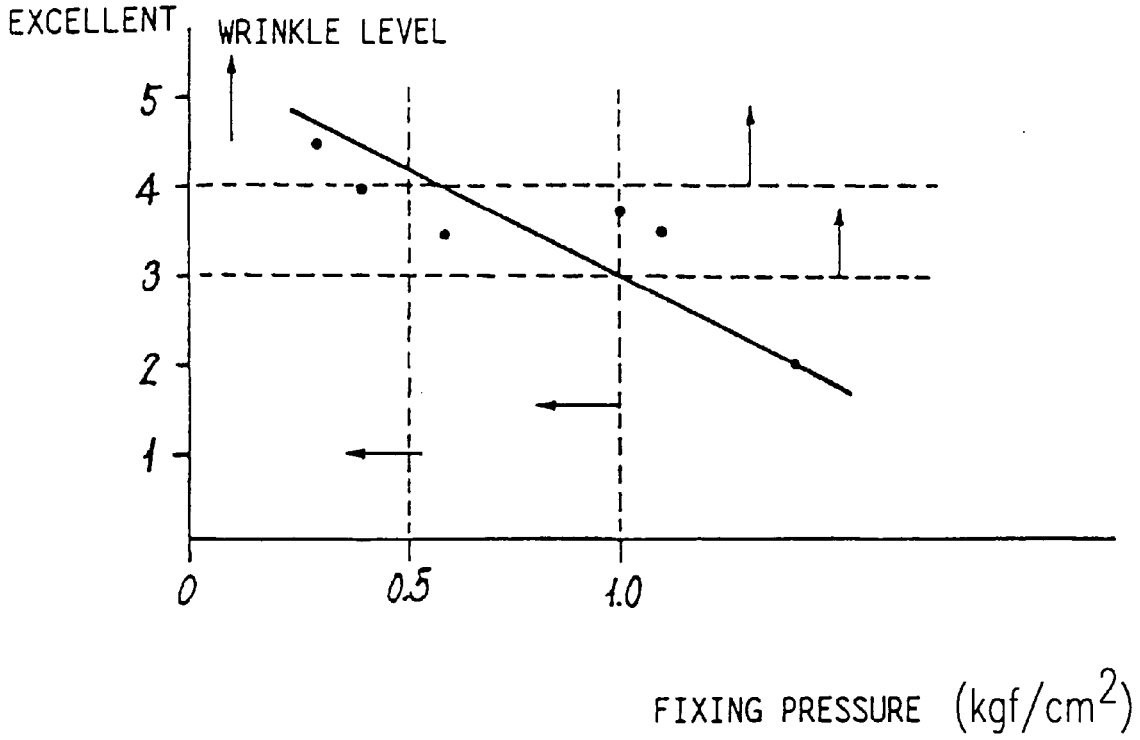
FIG. 15 presents a graph showing the results of an examination of the relationship between the fixing pressure in the first fixing process portion and the wrinkle level in the first embodiment of the present invention.

In the first embodiment, toners are temporarily fixed by heat conduction in the first fixing process, and the fixing belt 3 should be only lightly in contact with the pressure roller 4 so as not to cause wrinkles on the recording sheet. FIG. 15 shows the examination results of the relationship between the fixing pressure in the first fixing process portion 8 and the "wrinkle level" of a recording sheet. Here, the fixing pressure in the first fixing process portion 8 is defined as (tension of the fixing belt 3)/(contact area of the fixing belt 3 in the first fixing process portion 8).

If the fixing pressure is 1 kgf/cm$^2$, for instance, the tension of the fixing belt 3 is 9 kgf, the width of the fixing belt 3 is 310 mm, and the contact width of the fixing belt 3 is 3 mm. Accordingly, the fixing pressure can be calculated by 9 kgf/310 mm×0.3 cm⇆1 kgf/cm$^2$. If the fixing pressure is 0.5 kgf/cm$^2$, it is calculated by 4.5 kgf/310 mm×0.3 cm⇆0.5 kgf/cm$^2$.

The "wrinkle level" shows the degree of the number of wrinkles on the recording sheet to be transported through the fixing device. Here, Level 3 or higher is acceptable. More specifically, there are no wrinkles on Level 5; there are a few on level 4; there are an acceptable number of wrinkles on level 3; there are an unacceptable number of wrinkles on level 2; and there are too many wrinkles on level 1. According to the examination results shown in FIG. 15, if the fixing pressure in the first fixing process portion 8 is 1 kgf/cm$^2$, the wrinkle level is 3. If the fixing pressure in the first fixing process portion 8 is 0.5 kgf/cm$^2$ in surface pressure, the wrinkle level is 4.

According to the examination results, as long as the fixing pressure in the first fixing process portion 8 is 1 kgf/cm$^2$ or lower, or more preferably, 0.5 kgf/cm$^2$ or lower, the wrinkle level of the recording sheet is equal to or higher than that in the conventional thermal roller fixing device, despite the first fixing process portion added to the second fixing process portion, which is the original fixing process portion.

Figure 11:
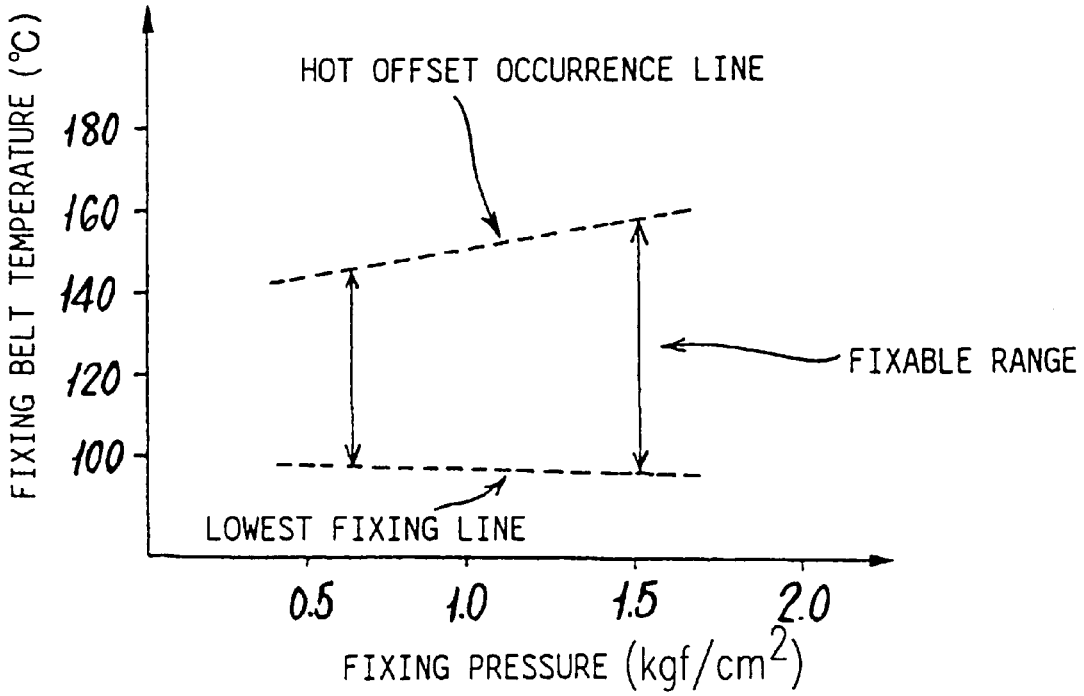
FIG. 11 presents graphs showing the results of an examination of the relationship between the fixing pressure and the fixing temperature in the second fixing process portion of the first embodiment of the present invention.

FIG. 11 shows the examination results of the relationship between the fixing pressure and the fixing temperature in the second fixing process portion on the outlet side where the pressure roller 4 presses the fixing roller 2 via the fixing belt 3. According to the examination results, to prevent a fault in fixing, the fixing pressure should be 1 kgf/cm$^2$ (9.8 N/cm$^2$) or higher, or more preferably, 2 kgf/cm$^2$ (19.6 N/cm$^2$) or higher.

Figure 17:
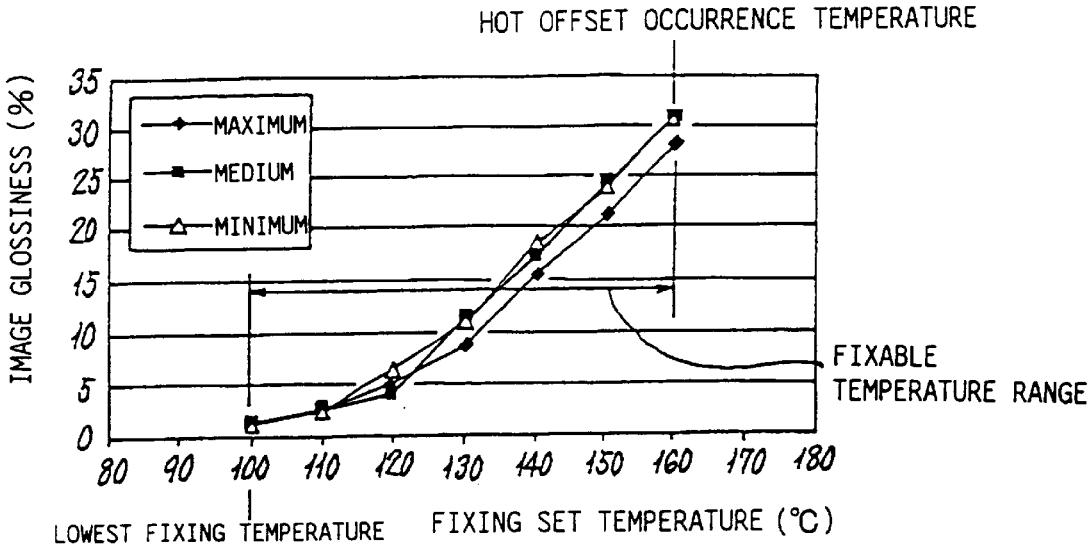
FIG. 17 presents graphs showing the results of an examination of the relationship between the fixing temperature and the image glossiness at a linear velocity of 200 mm/s in the first embodiment of the present invention.
Figure 18:
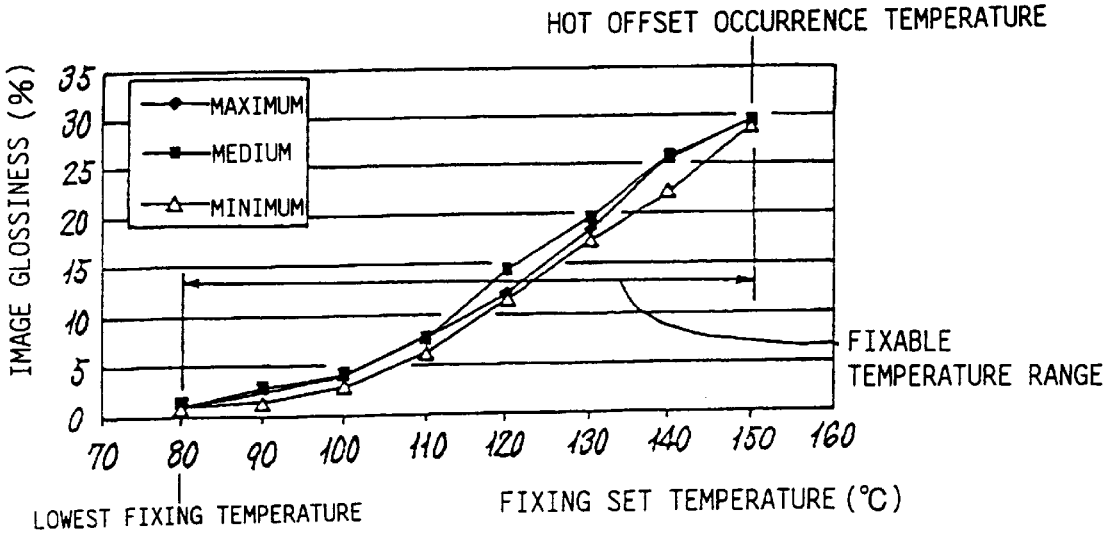
FIG. 18 presents graphs showing the results of an examination of the relationship between the fixing temperature and the image glossiness at a linear velocity of 100 mm/s in the first embodiment of the present invention.

FIG. 17 shows the results of an examination of the relationship between the fixing temperature and the image glossiness in the first embodiment. Here, the linear velocity is 200 mm/s, the nip time is 100 ms, and the fixing pressure in the second fixing process portion 9 is varied at 2.0 kgf/cm$^2$, 1.5 kgf/cm$^2$, and 0.5 kgf/cm$^2$. FIG. 18 shows the results of another examination of the relationship between the fixing temperature and the image glossiness in the first embodiment. Here, the linear velocity is 100 mm/s, the nip time is 200 ms, and the fixing pressure in the second fixing process portion 9 is varied at 2.0 kgf/cm$^2$, 1.5 kgf/cm$^2$, and 0.5 kgf/cm$^2$.

As is apparent from the above examination results, fixing can be properly performed in the first embodiment, even if the fixing pressure in the second fixing process portion 9 is low, and the fixing temperature in the second fixing process portion 9 is low. In a thermal roller fixing device for color image processing apparatus, the fixing pressure should be 3 kgf/cm$^2$ or higher, and the fixing temperature should be 160° C. or higher, so as to obtain the same fixing properties as the second fixing process portion 9 of the first embodiment.

The second embodiment of the present invention is the same as the first embodiment, except that the fixing pressure in the first fixing process portion 8 is 1 kgf/cm$^2$ or lower, and that the fixing pressure in the second fixing process portion 9 is higher than the fixing pressure in the first fixing process portion 8, 1 kgf/cm$^2$, for instance.

In the belt fixing device of the second embodiment, the fixing pressure in the first fixing process portion 8 is 1 kgf/cm$^2$ or lower, and the fixing pressure in the second fixing process portion 9 is equal to or higher than the fixing pressure in the first fixing process portion 8. Thus, smooth transportation of recording sheet and excellent fixing properties can be obtained. The belt fixing device can provide stable fixing properties for high-speed copying machines or color image processing apparatus.

In order to shorten the rise time and same energy required in the belt fixing device, the heater should be switched off in the stand-by condition, or an energy-saving mode (in which the fixing temperature in the stand-by condition is kept low so as to reduce energy consumption) should be employed. By reducing the heat capacity of the fixing belt and the heating roller, the rise time can be shortened.

Figure 12:
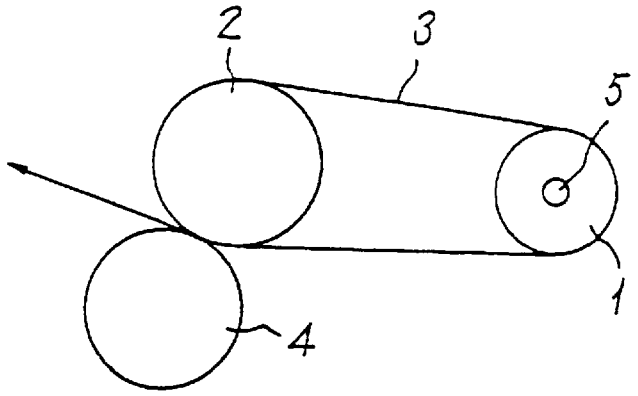
FIG. 12 is a schematic view of a third embodiment of the present invention.
Figure 13:
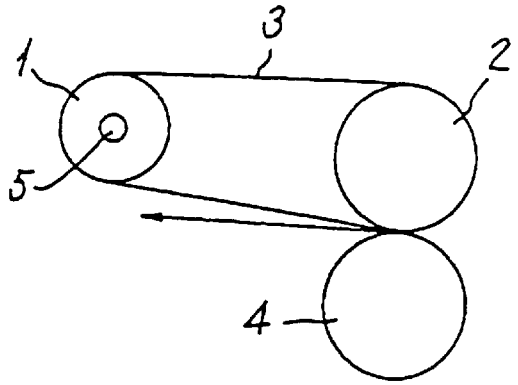
FIG. 13 is a schematic view of a fourth embodiment of the present invention.
Figure 14:
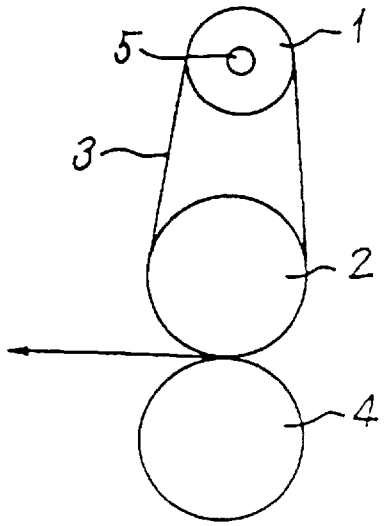
FIG. 14 is a schematic view of a fifth embodiment of the present invention.

The heat capacity of the fixing belt and the heating roller is therefore reduced so as to shorten the rise time and to reduce the energy consumption. FIGS. 12, 13, and 14 illustrate a third embodiment, a fourth embodiment, and a fifth embodiment of the present invention, respectively.

The belt fixing device of these embodiments basically comprises the endless-type fixing belt 3 having a low heat capacity arranged between the fixing roller 2 and the heating roller 1, and the pressure roller 4 provided for the fixing roller 2 via the fixing belt 3. The heating roller 1 contains the heater 5 for heating the fixing belt, and has a low heat capacity.

The heater 5 heats the fixing belt 3 via the heating roller 1. A temperature detecting unit comprising a thermistor detects the surface temperature of the heated portion of the fixing belt 3. Based on a temperature detection signal from the thermistor, a temperature control unit (not shown) controls the heater 5 so that the surface of the fixing belt 3 can be maintained at a predetermined temperature.

The fixing roller 2, the heating roller 1, the fixing belt 3, and the pressure roller 4 are all rotated by a drive (not shown). A recording sheet is transported through the fixing nip portion between the fixing belt 3 and the pressure roller 4, and a toner image formed on the recording sheet is heated by the fixing belt 3, and thus fixed to the recording sheet.

In this belt fixing device, the heating roller 1 does not require a heavy load. The fixing belt 3 can function properly, as long as it has a tensile strength of 1 kgf (9.8 N) on each side. Since the heating roller 1 for heating the faxing belt is separate from the fixing nip forming unit, the heating roller 1 does not require a fixing pressure and receive a heavy load. The heating roller 1 can be made smaller and thinner so as to reduce its heat capacity and to shorten the rise time.

The heating roller 1 should have a heat capacity of 45 cal/° C. or smaller, or more preferably, 15 cal/° C. or smaller. If the heating roller 1 has a heat capacity of 45 cal/° C. or smaller, the rise time is 30 seconds or less. If the heating roller 1 has a heat capacity of 15 cal/° C. or smaller, the rise time is 10 seconds or less.

In a conventional thermal roller fixing device, especially for color image forming apparatus, the fixing temperature is set so high that color toners are melted and then mixed to obtain excellent coloring and glossiness, and the fixing pressure is also high. If the fixing roller is made thin to reduce its heat capacity and to shorten the rise time, the fixing roller becomes too weak to endure the high fixing pressure.

In this embodiment, the heating roller 1 is subjected only to the tension of the fixing belt 3, which is in the range of 2 to 3 kg. In the conventional thermal roller fixing device, however, the fixing pressure is much higher than the tension of the fixing belt 3 of this embodiment. Even for a low-speed machine, the fixing pressure is 10 kg or more. The heating roller 1 of this embodiment can be thinner than that of the conventional thermal roller fixing device, and has a lower heat capacity.

In this embodiment, the fixing belt 3 is heated by the heating roller 1, which rotates with the fixing belt 3. Accordingly, only a light load is applied to the fixing belt 3, thereby preventing wear of the fixing belt 3. On the other hand, in the case where a secured member (such as a plane-type heater, a plate-type heater, and a fixed heater) heats the fixing belt, quick rising is possible, but the life of the fixing belt is shorter.

As described so far, the belt fixing device of this embodiment comprises the fixing roller 2, the heating roller 1, the endless-type fixing belt 3 stretched over the heating roller 1 and the fixing roller 2, and the pressure roller 4 facing the fixing roller 2 via the fixing belt 3. This belt fixing device fixes a toner image formed on a recording sheet being transported between the pressure roller 4 and the fixing belt 3. The heating roller 1 contains the heater 5 for heating the fixing belt, and has a low heat capacity. Thus, the rise time can be shortened and the energy consumption can be reduced.

According to a survey of what users think of the operation of making copies with a copying machine, they consider that the waiting period (the period of time from the machine is switched on until copying can be started) should preferably be 10 seconds or less. To limit the waiting period to less than 10 seconds and save energy, the energy saving mode, which has already been mentioned, should be employed.

To achieve the object of cutting the energy consumption by 50% and limiting the waiting period to less than 10 seconds at a low fixing temperature in the energy saving mode, the rise time of the fixing device should be 30 seconds or less in view of the relationship between the fixing temperature and the amount of power consumption during the waiting period. In doing so, the fixing belt and the fixing roller need to have a low heat capacity.

In the above embodiment, the thinner the heating roller 1, the lower its heat capacity. However, the heating roller 1 needs to be 0.3 mm or more in thickness to keep enough tensile strength for the fixing belt 3 and to prevent a bend in the axial direction and a depression on the surface. Also, the heating roller 1 has a small diameter, but it should be 20 mm or longer. The diameter of the heating roller 1 needs to be 20 to 40 mm (20 mm or longer in preventing a temperature drop, but 40 mm or shorter in keeping the roller strength). Thus, the heating roller 1 gives heat to the fixing belt 3 to prevent a temperature drop in continuous sheet feeding and maintain the surface of the fixing belt 3 at a constant temperature.

The material used for the heating roller 1 preferably has low specific heat and good heat conductivity, such as aluminum, lead, iron, and stainless steel. The fixing belt 3 is preferably made of nickel or polyimide to maintain excellent heat responsibility and flexibility, and the substrate 3*a* is 30 μm to 150 μm in thickness. The separate layer 3*b* of the fixing belt 3 also needs to have excellent heat responsibility. If the separate layer 3*b* is made of silicone rubber, its thickness should be 50 μm to 300 μm. If it is made of fluororesin, its thickness should be 10 μm to 50 μm.

With the fixing belt having a low heat capacity, the rise time limited to 30 seconds or less in the above embodiment may vary as follows:

(1) the rise time is approximately 10 seconds, in the case where the diameter of the heating roller 1 is 30 mm, and the heating roller 1 made of aluminum is 0.6 mm in thickness, or the heating roller 1 made of iron is 0.4 mm in thickness;

(2) the rise time is approximately 20 seconds, in the case where the diameter of the heating roller 1 is 40 mm, and the heating roller 1 made of aluminum is 0.8 mm in thickness, or the heating roller 1 made of iron is 0.4 mm in thickness; and (3) the rise time is approximately 30 seconds, in the case where the diameter of the heating roller 1 is 40 mm, and the heating roller 1 made of aluminum is 2.0 mm in thickness, or the heating roller 1 made of iron is 1.2 mm in thickness. Here, the output of the heater 5 is 1.3 kw, which is the largest possible value with a commercial power source of 100V/15A.

Accordingly, to set the rise time at 30 seconds or less, the low heat capacity heating roller 1 having the heater 5 inside should be 20 mm to 40 mm in diameter, and the metallic material that forms the heating roller 1 should be 0.3 mm to 2.0 mm in thickness.

If a heater having a high output is employed, a large rush current flows upon switching on the power source, and the fluorescent lamps flicker every time the heater is switched on and off. To avoid these problems, the output of the heater should be 700 W or lower. In view of this, the heating roller 1 is made of a metallic material of 0.3 mm to 1.0 mm in thickness.

The diameter of the heating roller 1 is preferably in the range of 20 mm to 40 mm so as to make the rise time short enough and the heat capacity low enough. In other words, the diameter of the heating roller 1 needs to be 20 mm or greater to prevent a temperature drop in continuous sheet feeding and maintain the surface of the fixing belt 3 at a constant temperature, as the fixing belt 3 receives heat from heat heating roller 1 rotating along with the fixing belt 3. If the diameter of the heating roller 1 exceeds 40 mm, the heating roller 1 becomes too thin and too weak. If the target rise time is set at 10 seconds or less, and the diameter of the heating roller 1 is 50 mm, for instance, the thickness of the heating roller 1 made of iron is 0.3 mm or less, and that of aluminum is 0.5 mm or less. Such a thin heating roller will be easily distorted by the tensile strength of the fixing belt 3 in the initial state and later.

In a sixth embodiment of the present invention, the heating roller 1 is 20 mm to 40 mm in diameter, and made of a low heat capacity metallic material which is 0.3 mm to 2.0 mm, more preferably, 0.3 mm to 1.0 mm in thickness.

In the sixth embodiment, the belt fixing device comprises the fixing roller 2, the heating roller 1, the endless-type fixing belt 3 stretched over the heating roller 1 and the fixing roller 2, and the pressure roller 4 facing the fixing roller 2 via the fixing belt 3. This belt fixing device fixes a toner image formed on a recording sheet to be transported between the pressure roller 4 and the fixing belt 3. The heating roller 1 contains the heater 5 for heating the fixing belt. The diameter of the heating roller 1 is 20 mm to 40 mm. The metallic material that forms the heating roller 1 is 0.3 mm to 2.0 mm in thickness, so that the heating roller 1 has a low heat capacity. Thus, the rise time can be shortened, and energy consumption can be reduced.

If a heater is provided in the pressure roller to improve the fixing properties, the rise time of the fixing device can be shortened. If the heater is not provided in the pressure roller, the temperature of the fixing belt dramatically drops when the fixing belt is brought into contact with the pressure roller in the fixing nip portion right after the fixing belt starts rotating. This might cause a fault in fixing. Therefore, it is necessary to set a pre-rotation time in which the fixing belt recovers a predetermined temperature. The above-mentioned heating roller having a low heat capacity is advantageous in that the temperature rising speed is higher, and the pre-rotation time is accordingly shorter.

Since one of the features of the belt fixing device of the present invention is the low pressure (low temperature) fixing operation, the pressure rollers can be thin and have a low heat capacity. The heat capacity of the heating roller in the belt fixing device of the present invention is 36 cal/° C. or lower (in this embodiment, the diameter of the heating roller is 40 mm to 60 mm, and the thickness is 0.3 mm to 1.5 mm).

In a seventh embodiment of the present invention, the heating roller 1 does not require a heavy load, and is made of a light-transmissible material (such as heat-resistant glass). A layer having a high radiation absorption rate is formed on the inner surface of the fixing belt 3 in contact with the heating roller or on the surface of the heating roller 1. Such a layer may be formed by black paint, carbon process, or carbon dispersion within the fixing belt 3. The fixing belt 3 is heated by radiation heat from the heating roller 1, so that prompt rising of the device becomes possible.

The belt fixing device of the seventh embodiment comprises the fixing roller 2, the heating roller 1, the endless-type fixing belt 3 stretched over the heating roller 1 and the fixing roller 2, and the pressure roller 4 facing the fixing roller 2 via the fixing belt 3. The belt fixing device fixes a toner image formed on a recording sheet to be transported between the pressure roller 4 and the fixing belt 3. The heating roller 1 contains the heater 5 for heating the fixing belt. The heating roller 1 is light transmissible, and a layer having a high radiation absorption rate is formed either on the inner surface of the fixing belt 3 or on the surface of the heating roller 4. Thus, the rising time can be shortened, and the energy consumption can be reduced. In the case where the heater is provided in the heating roller, low pressure (low temperature) fixing can be performed in the belt fixing device of the present invention, so that there will be no problem with the strength of the light-transmissible heating roller.

Figure 19:
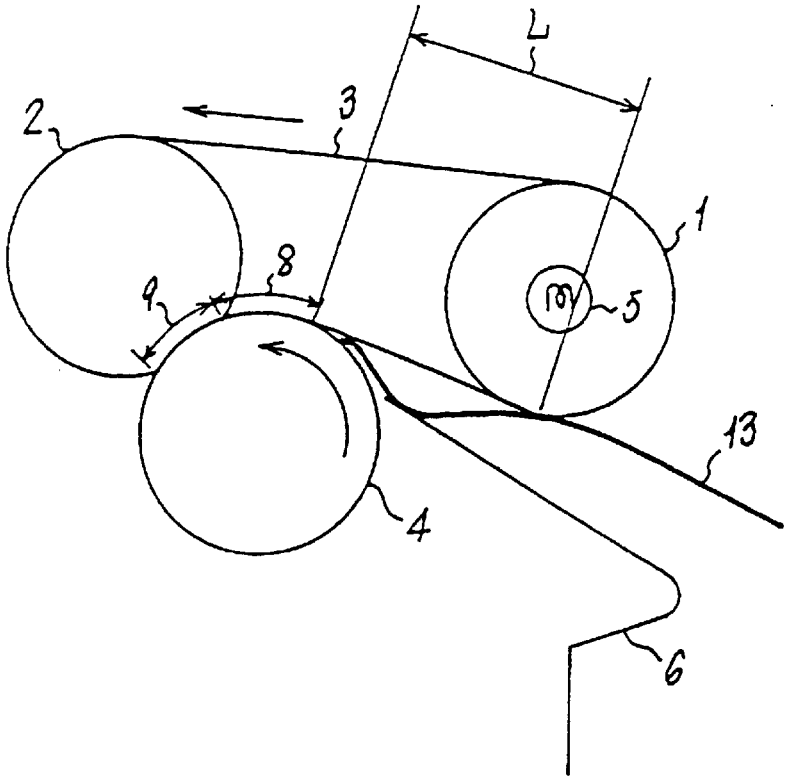
FIG. 19 is an enlarged schematic view of a part of the first embodiment of the present invention.

In the belt fixing device of the first embodiment, a non-fixed image on a recording sheet 13 is not scratched by the fixing belt 3, as long as the recording sheet 13 moves in synchronization with the fixing belt 3 before the fixing process, as shown in FIG. 19. However, if there is a difference in the sheet transportation speed between the fixing device and the other parts of the image forming apparatus, and if the sheet transportation speed of the fixing device is lower than that of the image forming apparatus itself, there will be slack in the recording sheet 13. In such a case, when the non-fixed image on the recording sheet 13 is brought into contact with the fixing belt 3, it is scratched by the fixing belt 3 due to the asynchronization between the recording sheet 13 and the fixing belt 3.

The amount of slack in the recording sheet 13 is larger at a farther spot from the inlet of the fixing process portions 8 and 9. In other words, if the recording sheet 13 is brought into contact with the fixing belt 3 due to the slack in the recording sheet 13 in the vicinity of the inlet of the fixing process portions 8 and 9, the amount of scratching caused by the asynchronization between the non-fixed image and the fixing belt 3 becomes smaller, because the amount of slack is very small.

Figure 20:
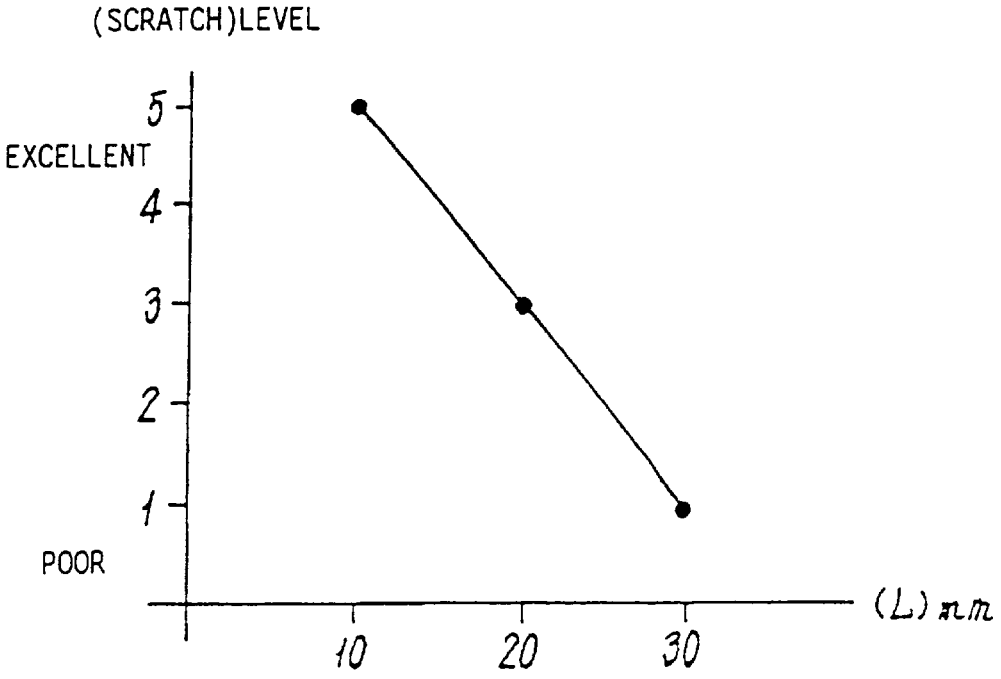
FIG. 20 presents a graph showing the relationship between the scratch level of a non-fixed image and the distance from the separate position where the fixing belt separates from the heating roller to the first contact position of the fixing belt and the pressure roller.

To prevent scratching in a non-fixed image, the non-fixed image should be allowed to be in contact with the fixing belt 3 in the vicinity of the inlet of the fixing process portion 8. Therefore, it is necessary to shorten the length L between the point where the fixing belt 3 separates from the heating roller 1 and the point where the fixing belt 3 is first brought into contact with the pressure roller 4. FIG. 20 shows the relationship between the length L and the scratch level by the examination conducted in the first embodiment. Here, if the length L is 20 mm or shorter, the amount of asynchronization between the non-fixed image and the fixing belt can be ignored, causing no scratching in the non-fixed image.

According to the examination results shown in FIG. 20, when the length L is 20 mm, the scratch level is 3; when the length L is 15 mm, the scratch level is 4; and when the length L is 10 mm or shorter, the scratch level is 5. Here, the scratch level represents the degree of scratching in the non-fixed image passing through the fixing device. The scratch level is 3 or higher is acceptable from the viewpoint of users. The scratch level 5 represents the state in which no scratching appears in the non-fixed image. The scratch level 2 or lower is unacceptable from the viewpoint of users.

In an eighth embodiment of the present invention, the length L from the spot where the fixing belt 3 separates from the heating roller 1 to the spot where the fixing belt 3 is first brought into contact with the pressure roller 4 is set at 20 mm or shorter, so that scratching a non-fixed image can be prevented.

The belt fixing device of the eighth embodiment comprises the fixing roller 2, the endless-type fixing belt 3 stretched over the fixing roller 2, the heating roller 1 for heating the fixing belt 3, the pressure roller facing the fixing roller 2 via the fixing belt 3, and the heater 5 for heating either or both of the pressure roller 4 and the heating roller 1. The fixing pressure in the first fixing process portion 8, where the pressure roller 4 is brought into contact with the fixing belt 3 without pressing the fixing roller 2, is set so low that not wrinkles will appear in the material onto which a toner image is to be fixed. The fixing pressure in the second fixing process portion 9, where the pressure roller 4 presses the fixing roller 2 via the fixing belt 3, is set so that desired fixing can be performed. The distance from the spot where the fixing belt 3 is heated by the heating roller 1 to the spot where the fixing belt 3 is first brought into contact with the pressure roller 4 is 20 mm or shorter, so that scratching a non-fixed image can be sufficiently prevented.

In the eighth embodiment, a roller-type heating unit or a heating unit having a heating layer formed on a stationary substrate may be employed in stead of the heating roller 1. The heater 5 for heating the fixing belt may be disposed in the pressure roller 4 or both in the heating roller 1 and in the pressure roller 4, so that the same effects as in the first embodiment can be obtained.

Figure 21:
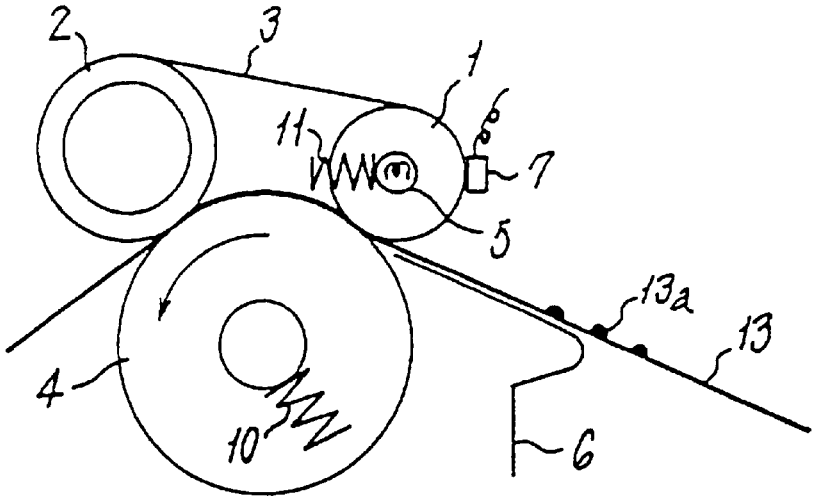
FIG. 21 is a schematic view of a thirteenth embodiment of the present invention.

FIG. 21 Illustrates a ninth embodiment of the present invention. The belt fixing device of the ninth embodiment is the same as that of the eighth embodiment, except that the pressure roller 4 presses the heating roller 1 via the fixing belt 3 in the first fixing process portion. The fixing belt 3 remains in contact with the pressure roller 4 from the first fixing process portion to the second fixing process portion.

If the fixing pressure in the first fixing process portion is 0.5 kgf/cm$^2$ or lower in this belt fixing device, no wrinkles appear in the recording sheet 13. When the recording sheet 13 is transported through the first fixing process portion, toners are temporarily fixed onto the recording sheet 13 by the heat conduction from the fixing belt 3. The fixing pressure in the first fixing process portion should be low enough to prevent wrinkles in the recording sheet 13, and therefore the fixing belt 3 should be only lightly in contact with the pressure roller 4.

Figure 22:
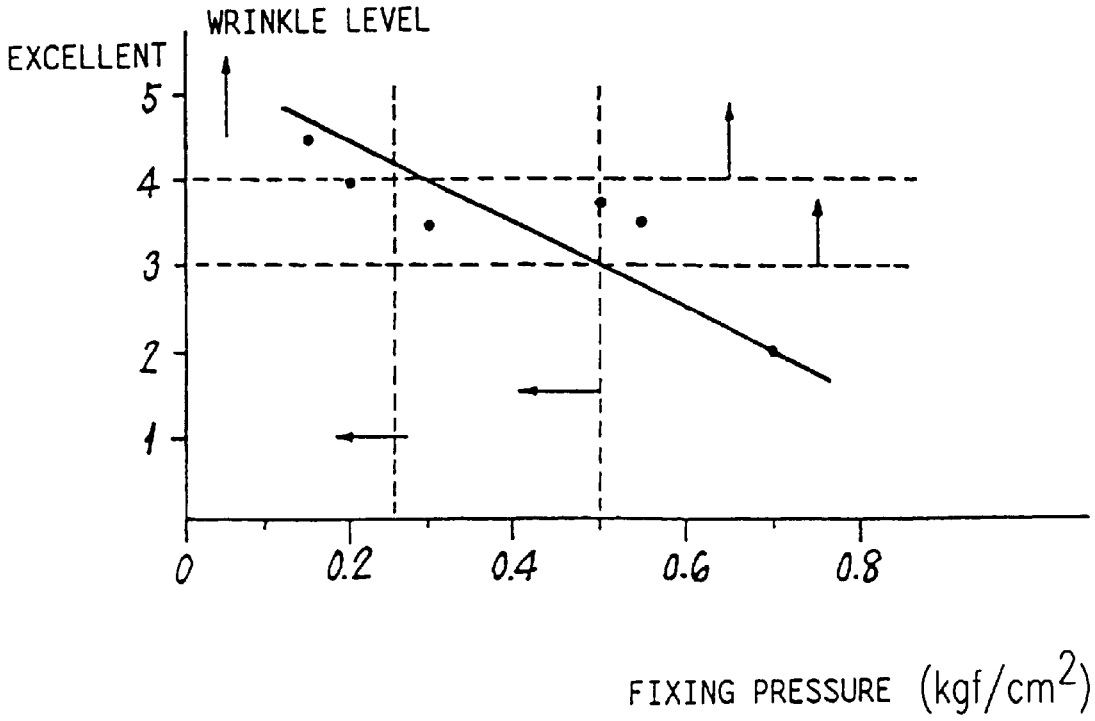
FIG. 22 presents a graph showing the relationship between the wrinkle level of the recording sheet and the fixing pressure in the first fixing process portion determined in the examination of the belt fixing device.

FIG. 22 shows the relationship between the fixing pressure in the first fixing process portion and the wrinkle level of the recording sheet 13. According to the relationship between the fixing pressure in the first fixing process portion and the wrinkle level of the recording sheet 13, if the allowable fixing pressure is 0.5 kgf/cm$^2$ or lower, more preferably, 0.3 kgf/cm$^2$ or lower, the wrinkle occurrence rate in the recording sheet 13 is much lower than in the conventional thermal roller fixing device, even with the first fixing process portion added to the second fixing process portion.

The relationship between the fixing pressure in the first fixing process portion and the wrinkle level of the recording sheet 13 shown in FIG. 22 is determined from the nip width and the fixing force in the first fixing process portion formed by the heating roller 1 in contact with the pressure roller 4 via the fixing belt 3. The fixing pressure in the first fixing process portion is defined as (the fixing force in the first fixing process portion the fixing nip area in the first fixing process portion ). If the fixing pressure in the first fixing process portion is 0.5 kgf/cm$^2$, the fixing force in the first fixing process portion is 5 kg, the width of the fixing belt 3 is 310 mm, and the fixing nip width in the first fixing process portion is 3 mm (5 kgf/310 mm×0.3 cm⇆0.5 kgf/cm$^2$).

If the fixing pressure in the first fixing process portion is 0.3 kgf/cm$^2$, the fixing force in the first fixing process portion is 3 kg, the width of the fixing belt 3 is 310 mm, and the fixing nip width in the first fixing process portion is 3 mm (3.0 kgf/310 mm×0.3 cm⇆0.3 kgf/cm$^2$). According to the examination results shown in FIG. 22, when the fixing pressure in the first fixing process portion is 0.5 kgf/cm$^2$, the wrinkle level is 3; and when the fixing pressure in the first fixing process portion is 0.3 kgf/cm$^2$, the wrinkle level is 4. Therefore, the fixing pressure in the first fixing process portion needs to be 0.5 kgf/cm$^2$ or lower, or more preferably, 0.3 kgf/cm$^2$ or lower.

Figure 24:
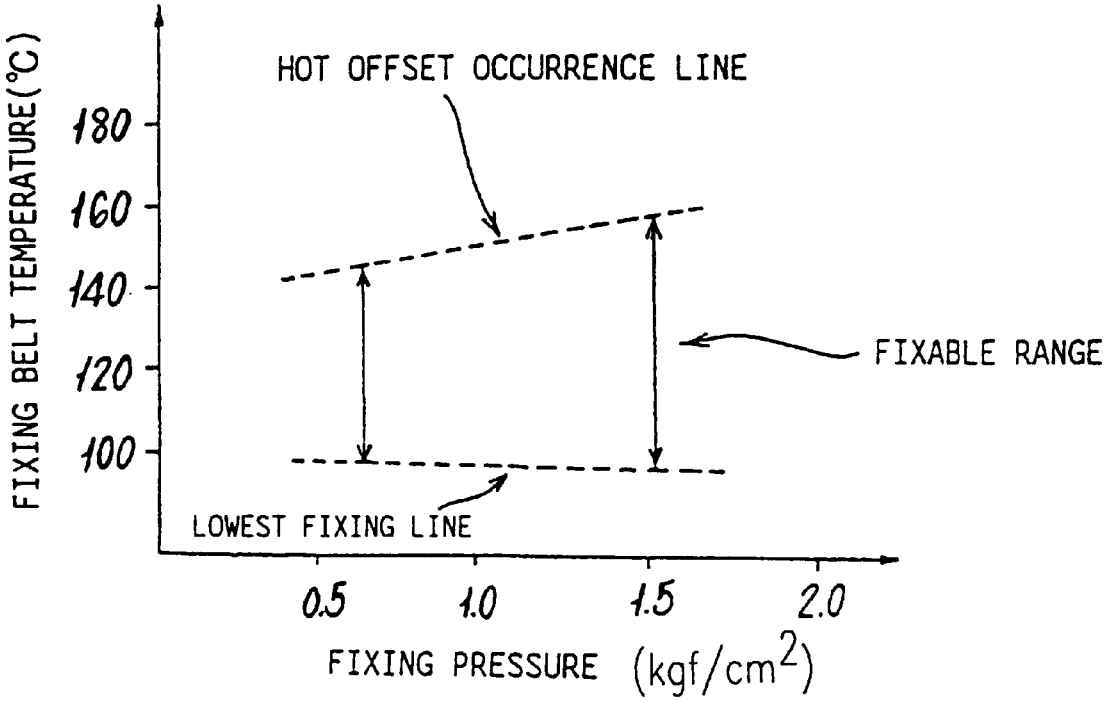
FIG. 24 presents graphs showing the relationship between the fixing temperature and the fixing pressure in the second fixing process portion determined in the examination of the belt fixing device.

According to the relationship between the fixing pressure and the fixing temperature in the second fixing process portion shown in FIG. 24, the fixing pressure in the second fixing process portion on the outlet side formed by the pressure roller 4 pressing the fixing roller 2 via the fixing belt 3 should be 0.5 kgf/cm$^2$ (4.9 N/cm$^2$) or higher, or more preferably, 1.5 kgf/cm$^2$ or higher.

FIG. 17 shows the examination results of the relationship between the fixing set temperature and the image glossiness in the ninth embodiment. Here, the linear velocity is 200 mm/s, the nip time is 100 ms, and the fixing pressure in the second fixing process portion is 2.0 kgf/cm$^2$ (maximum), 1.5 kgf/cm$^2$ (medium), and 0.5 kgf/cm$^2$ (minimum). FIG. 18 shows the examination results of the relationship between the fixing temperature and the image glossiness in the ninth embodiment, where the linear velocity is 100 mm/s, the nip time is 200 ms, and the fixing pressure in the second fixing process portion is 2.0 kgf/cm$^2$ (maximum), 1.5 kgf/cm$^2$ (medium), and 0.5 kgf/cm$^2$ (minimum.

The above examination results prove that fixing can be performed even if the fixing pressure and the fixing temperature in the second fixing process portion are both low in the ninth embodiment. In a conventional thermal roller fixing device for color image forming apparatus, however, the fixing pressure should be 3 kgf/cm$^2$ or higher, and the fixing temperature should be 160° C. or higher, so as to obtain fixing as excellent as in the second fixing process portion 9 of the above embodiment.

Accordingly, in the ninth embodiment of the present invention, the fixing pressure in the first fixing process portion is set at 0.5 kgf/cm$^2$ or lower, or more preferably, 0.3 kgf/cm$^2$ or lower, while the fixing pressure in the second fixing process portion is set at 0.5 kgf/cm$^2$ (4.9 N/cm$^2$) or higher, or more preferably, 1.5 kgf/cm$^2$ (9.8 N/cm$^2$) or higher.

The belt fixing device of the ninth embodiment comprises the fixing roller 2, the heating roller 1, the endless-type fixing belt stretched over the heating roller 1 and the fixing roller 2, the pressure roller 4 facing the fixing roller 2 via the fixing belt 3, and the heater 5 for heating the fixing belt provided in either or both of the pressure roller 4 and the heating roller 1. The fixing pressure in the first fixing process portion, where the pressure roller 4 does not press the fixing roller 2 in the transportation direction of the recording sheet while it presses the heating roller 1 via the fixing belt 3, is set at 0.5 kgf/cM$^2$ or lower, so as not to cause wrinkles in the recording sheet. The fixing pressure in the second fixing process portion, where the pressure roller 4 presses the fixing roller 2 via the fixing belt 3, is set so that desired fixing can be performed. Thus, wrinkles in a recording sheet and scratching in a non-fixed image can be efficiently prevented.

In the ninth embodiment, the same effects as in the second embodiment can be obtained by disposing the heater 5 for heating the fixing belt in the pressure roller 4 or in both the heating roller 1 and the pressure roller 4.

Figure 23:
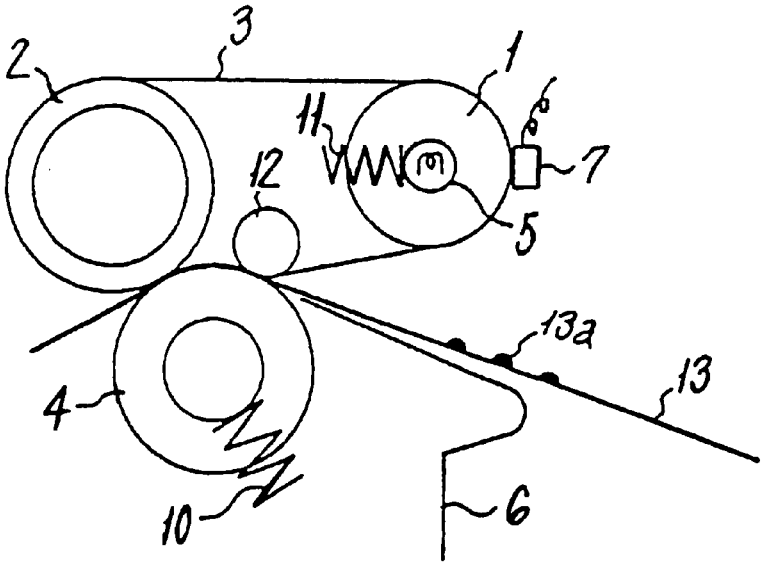
FIG. 23 is a schematic view of a tenth embodiment of the present invention.

FIG. 23 illustrates a tenth embodiment of the present invention. The tenth embodiment is the same as the eighth embodiment, except that an auxiliary roller 12 which serves as a guide member is provided to the inner side of the fixing belt 3 in the vicinity of the point where the fixing belt 3 heated by the heating roller 1 is first brought into contact with the pressure roller 4 (more specifically, 10 mm or shorter from the point where the fixing belt 3 is brought into contact with the pressure roller). The auxiliary roller 12 pressing the pressure roller 4 via the fixing belt 3 forms the first fixing process portion.

The heating roller 1 is arranged so that the fixing belt 3 stays away from the recording sheet 13 having a non-fixed toner image while it is situated within the length L between the point where the fixing belt 3 separates from the heating roller 1 and the spot where the fixing belt 3 is first brought into contact with the pressure roller 4 (so that the fixing belt 3 will not touch the non-fixed toner image on the recording sheet 13). Thus, within the length L, the fixing belt 3 is not brought into contact with the non-fixed toner image on the recording sheet 13, thereby preventing scratching the non-fixed toner image.

As described so far, the belt fixing device of the tenth embodiment comprises the fixing roller 2, the heating roller 1, the endless-type fixing belt 3 stretched over the heating roller 1 and the fixing roller 2, the pressure roller 4 facing the fixing roller 2 via the fixing belt 3, and the fixing belt heating heater 5 provided in either or both of the pressure roller 4 and the heating roller 1. In this belt fixing device, the fixing pressure in the first fixing process portion, where the pressure roller 4 is first brought into contact with the fixing belt 3 without pressing the fixing roller 2 in the transporting direction of the recording sheet, is set low enough to prevent wrinkles in the recording sheet. Meanwhile, the fixing pressure in the second fixing process portion, where the pressure roller 4 presses the fixing roller 2 via the fixing belt 3, is set so that desired fixing can be performed. This belt fixing device is provided with the auxiliary roller 12 as a guide member disposed on the inner side of the fixing belt 3 in the vicinity of the point where the fixing belt 3 heated by the heating roller 1 is first brought into contact with the pressure roller 4. The heating roller 1 is arranged so that the fixing belt 3 stays away from the recording sheet having a non-fixed toner image while it is situated between the point where the fixing belt 3 separates from the heating roller 1 and the point where the fixing belt 3 is first brought into contact with the pressure roller 4. Thus, scratching in the non-fixed image can be sufficiently prevented.

In the tenth embodiment, the same effect as in the third embodiment can be obtained by disposing the fixing belt heater 5 in the pressure roller 4 or both in the heating roller 1 and the pressure roller 4.

An eleventh embodiment of the present invention is the same as the eighth embodiment, except that the auxiliary roller 12 is provided as a guide member on the inner side of the fixing belt in the vicinity of the point where the fixing belt 3 heated by the heating roller 1 is first brought into contact with the pressure roller 4, as in the tenth embodiment. Also, the fixing pressure in the first fixing process portion, where the pressure roller 4 presses the auxiliary roller 12 via the fixing belt 3, is set low enough to prevent wrinkles in the recording sheet 13.

In this embodiment, the heating roller 1 is arranged so that the fixing belt 3 stays away from the recording sheet 13 having a non-fixed toner image while it is situated within the length L between the point where the fixing belt 3 separates from the heating roller 1 and the point where the fixing belt 3 is first brought into contact with the pressure roller 4 (so that the fixing belt 3 is not brought into contact with the non-fixed toner image). The fixing pressure in the second fixing process portion, where the pressure roller 4 presses the fixing roller 2 via the fixing belt 3, is set so that desired fixing can be performed.

In the belt fixing device of this embodiment, the fixing pressure in the first fixing process portion is 0.5 kgf/cm$^2$ or lower, or more preferably, 0.3 kgf/cm$^2$ or lower, as in the ninth embodiment. With such a fixing pressure in the first fixing process portion, wrinkles can be prevented in the recording sheet 13. Also, according to the examination results shown in FIG. 24, the fixing pressure in the second fixing process portion needs to be 0.5 kgf/cm$^2$ or higher (4.9 N/cm$^2$), or more preferably, 1.5 kgf/cm$^2$ or higher, so as to put enough pressure to prevent faulty fixing.

Accordingly, in the eleventh embodiment, the fixing pressure in the first fixing process portion is 0.5 kgf/cm$^2$ or lower, or more preferably, 0.3 kgf/cm$^2$ or lower. The fixing pressure in the second fixing process portion is 0.5 kgf/cm$^2$ or higher (4.9 N/cm$^2$), or more preferably, 1.5 kgf/cm$^2$ or higher.

As described so far, the belt fixing device of the eleventh embodiment comprises the fixing roller 2, the heating roller 1, the endless-type fixing belt 3 stretched over the heating roller 1 and the fixing roller 2, the pressure roller 4 facing the fixing roller 2 via the fixing belt 3, the pressure roller 4 facing the fixing roller 2 via the fixing belt 3, the fixing belt heater 5 disposed in either or both of the pressure roller 4 and the heating roller 1, and the auxiliary roller 12 as a guide member disposed on the inner side of the fixing belt 3 in the vicinity of the spot where the fixing belt 3 is first brought into contact with the pressure roller 4 in the transporting direction of the recording sheet. The heating roller 1 is arranged so that the fixing belt 3 stays away from the recording sheet having a non-fixed toner image thereon while it is situated between the spot where the fixing belt 3 separates from the heating roller 1 and the spot where the fixing belt 3 is first brought into contact with the pressure roller 4. The fixing pressure in the first fixing process portion, where the pressure roller 4 presses the guide member 12 via the fixing belt 3, is set at 0.5 kgf/cm$^2$ or lower, so that no wrinkles will appear in the recording sheet. The fixing pressure in the second fixing process portion, where the pressure roller 4 presses the fixing roller 2 via the fixing belt 3, is set so that desired fixing can be performed. Thus, wrinkles in a recording sheet and scratching a non-fixed image can be effectively prevented.

In the eleventh embodiment, the same effect as in the fourth embodiment can be obtained by disposing the fixing belt heater 5 in the pressure roller 4 or both in the heating roller 1 and the pressure roller 4.

Figure 25:
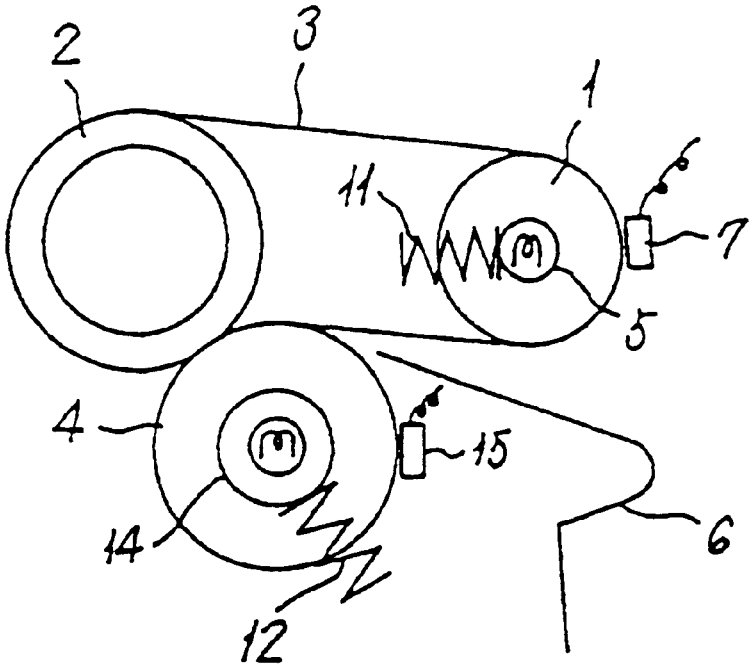
FIG. 25 is a schematic view of a twelfth embodiment of the present invention.
Figure 26:
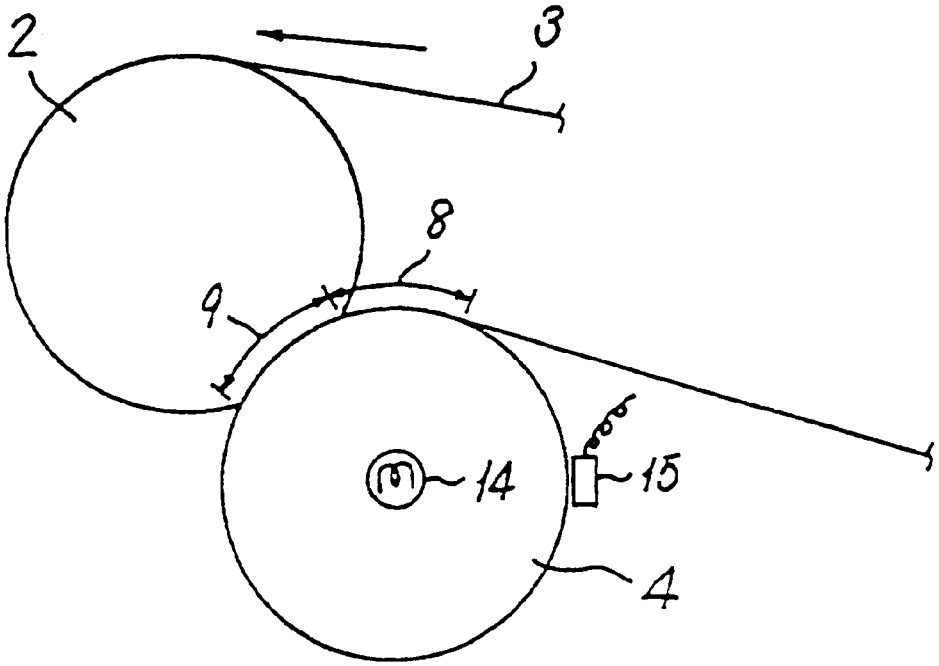
FIG. 26 is an enlarged view of a part of the structure shown in FIG. 25.

FIG. 25 Illustrates a belt fixing device having a heater 14 inside the pressure roller 4 of the first embodiment. FIG. 26 shows a partially enlarged view of the fixing device of Fig .25. In this belt fixing device, a temperature detecting unit 15 that is a thermistor detects the surface temperature of the pressure roller 4. Based on a temperature detection signal from the thermistor 15, switching on and off the heater 14 is controlled by a temperature control unit (not shown) to maintain the surface of the pressure roller 4 at a predetermined temperature.

A recording sheet as a material to which a toner image is to be fixed is guided by an inlet guide plate 6 and transported between the fixing belt 3 and the pressure roller 4. The fixing belt 3 and the pressure roller 4 then heat the toner image on the recording sheet, thereby fixing the toner image onto the recording sheet.

In this belt fixing device, the temperature control unit controls the surface temperature of the pressure roller 4 having the heater 14 therein. By doing so, the recording sheet is also heated from its reverse side, and more excellent fixing and greater restrictions on offset can be obtained.

Figure 27:
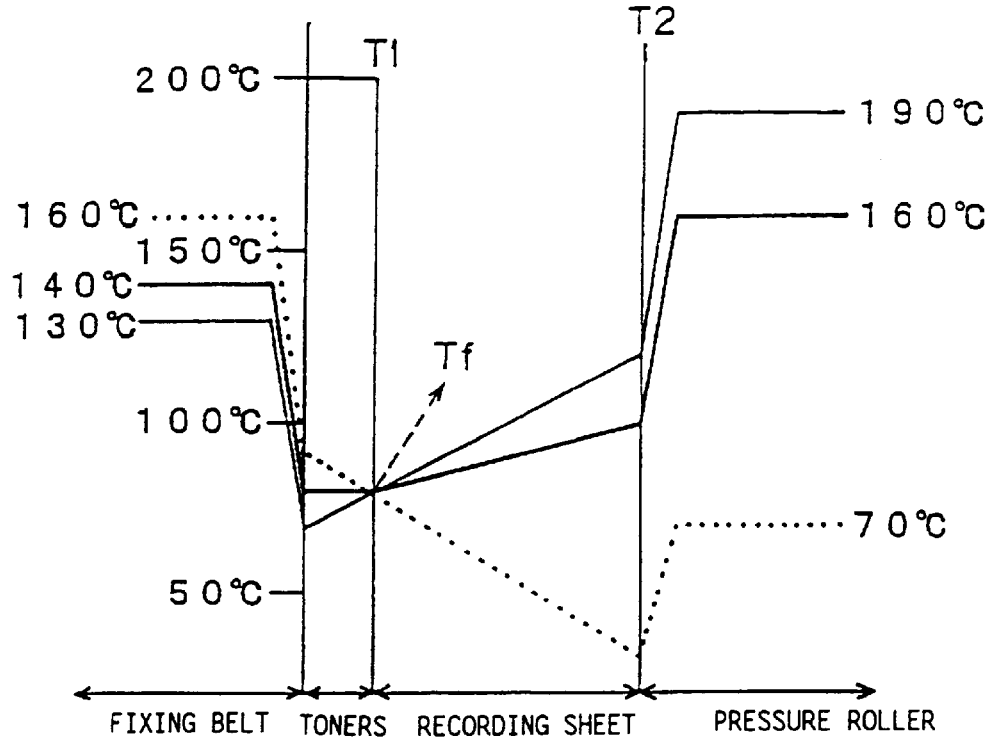
FIG. 27 presents graphs showing the examinations of the twelfth embodiment of the present invention.

FIG. 27 shows the effect of the heater 14 built in the pressure roller 4 of this belt fixing device. In FIG. 27, the interface temperature Tf between the toner and the recording sheet is constant. As the surface temperature of the pressure roller 4 changes from 70° C. to 160° C. to 190° C. with the same fixing properties, the temperature of the fixing belt 3 lowers from 160° C. to 140° C. to 130° C., as shown in FIG. 27.

Accordingly, the higher the surface temperature of the pressure roller 4, the lower the lowest possible value in the fixing range. Meanwhile, the hot offset occurrence temperature, which is the highest value in the fixing range, is under the influence of the interface temperature T1 between the fixing belt 3 and the toner. With the interface temperature Tf being constant, the higher the temperature of the pressure roller, the lower the interface temperature T1 (representing the possibility of separation between the fixing belt and the toner). Accordingly, the possibility of hot offset occurrence becomes smaller.

Figure 28:
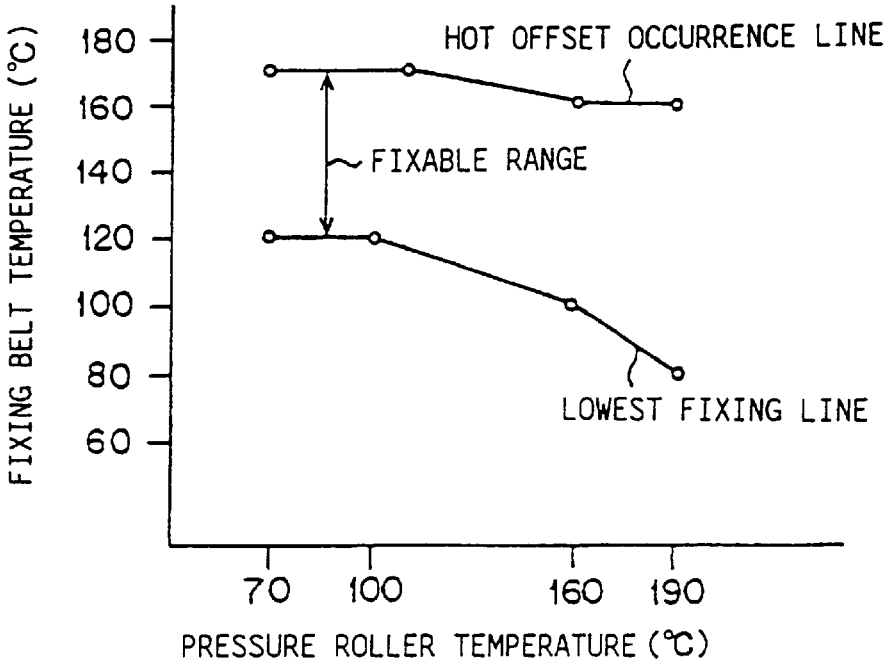
FIG. 28 presents graphs showing the examination results in the twelfth embodiment of the present invention.

FIG. 28 shows the examination results. In FIG. 28, the higher the surface temperature of the pressure roller 4, the larger the fixing range. Here, the hot offset occurrence temperature does not greatly change, but the lowest possible fixing temperature drops.

From the above examination results, it is apparent that, besides the heater in the heating roller 1, the heater 14 built in the pressure roller 4 widens the fixing range.

While the fixing belt 3 and the pressure roller 4 rotate, they give heat to each other in this belt fixing device. As a result, the temperature becomes unstable, and the image quality (glossiness) deteriorates. Especially after the stand-up, if the difference between the temperature of the fixing belt 3 and the surface temperature of the pressure roller 4 is large during the waiting period and the image formation starting period, the surface temperature of the pressure roller 4 adversely affects the temperature of the fixing belt 3. Because of this, the image quality does not improve until after the temperature of the fixing belt 3 is stabilized by continuous rotation of the fixing belt 3 and the pressure roller 4. To prevent this problem, the difference between the predetermined temperature of the fixing belt 3 and the predetermined surface temperature of the pressure roller 4 should be 40° C. or smaller. It has become apparent that a smaller difference in the predetermined temperatures reduces image quality deterioration due to the adverse influence of the surface temperature of the pressure roller 4 upon the temperature of the fixing belt 3.

In this belt fixing device, the temperature of the fixing belt 3 greatly drops, because the pressure roller 4 deprives the fixing belt 3 of heat in the fixing nip portion right after the rotation start of the fixing belt 3. However, as the temperature of the pressure roller 4 rises with time during the rotation period of the fixing belt 3, the temperature of the fixing belt 3 in the fixing nip portion gradually rises. Because of this, there is a great difference in image quality (especially image glossiness) between the time right after the print start (right after the image formation start of the image forming apparatus) and the finishing time of the continuous image forming operation. To solve such a problem, the pressure roller and the fixing belt 3 may be rotated before the print start until the pressure roller 4 reaches the predetermined temperature. However, such a method prolongs the waiting time, thereby lowering the workability.

In view of the above facts, a twelfth embodiment of the present invention provides a belt fixing device having the heater 14 inside the pressure roller 4 of the first embodiment. In this belt fixing device, the temperature of the fixing belt 3 and the surface temperature of the pressure roller 4 are set at the respective predetermined temperatures, so that the difference between the temperature of the fixing belt 3 and the surface temperature of the pressure roller 4 becomes 40° C. or lower during the rotating operation. The temperature control unit controls the switching on and off of the heater 5 based on a temperature detection signal from the thermistor 7 so as to maintain the surface of the fixing belt 3 at the predetermined temperature. The temperature control unit also controls the switching on and off of the heater 14 based on a temperature detection signal from the thermistor 7, which detects the surface temperature of the pressure roller 4, so as to maintain the surface of the pressure roller 4 at the predetermined temperature.

Figure 31:
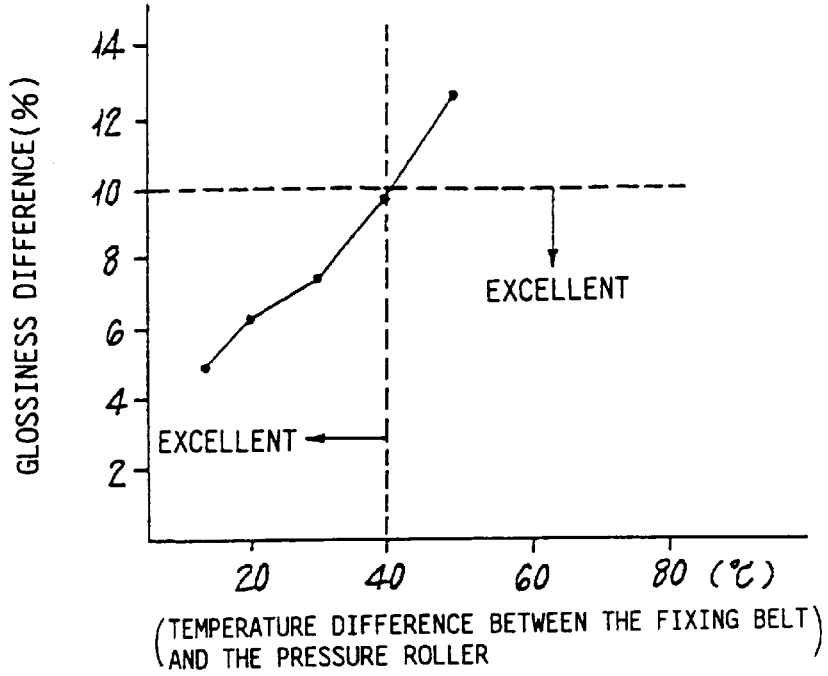
FIG. 31 presents a graph showing the examination results in the twelfth embodiment of the present invention.

FIG. 31 shows the difference in glossiness between the fixed image right after the print start and the fixed image after image formation have been performed on fifth sheets by the image forming apparatus. Here, the fixing belt 3 is set at 130° C., while the temperature of the pressure roller 4 is varied. For instance, when the difference between the temperature of the fixing belt 3 and the temperature of the pressure roller 4 is 50° C. (i.e., when the temperature of the pressure roller 4 is 80° C.). the image glossiness of the first sheet is 7% on the average, and the image glossiness of the fiftieth sheet is 20% on the average.

When the difference between the temperature of the fixing belt 3 and the temperature of the pressure roller 4 is 40° C. (i.e., when the temperature of the pressure roller 4 is 90° C.), the image glossiness of the first sheet is 10% on the average, and the image glossiness of the fiftieth sheet is 20% on the average. When the difference between the temperature of the fixing belt 3 and the temperature of the pressure roller 4 is 30° C. (i.e., when the temperature of the pressure roller 4 is 100° C.), the image glossiness of the first sheet is 13% on the average, and the image glossiness of the fiftieth sheet is 20% on the average.

Generally, the image glossiness difference does not stand out if it is 10% or lower. Accordingly, the temperature difference between the fixing belt 3 and the pressure roller 4 should be restricted to 40° C. or lower. Since there is a strong correlation between the fixing temperature and the image glossiness, the results of experiments at different set temperatures are substantially the same.

If no heater is provided to the pressure roller, the fixing belt and the pressure roller need to be rotated prior to the operation start until the pressure roller reaches the predetermined temperature (i.e., until the temperature difference between the fixing belt and the pressure roller becomes 40° C. or lower). In such a case, the preliminary rotation period should be as short as possible for a shorter waiting time. To shorten the preliminary rotation period, the heat capacity of the pressure roller is reduced to facilitate its temperature recovery, or a heat insulating layer is arranged below the release layer of the pressure roller so as to prevent a drop in temperature. As the belt fixing device of the present invention is characterized by low pressure (low temperature) fixing, the pressure roller can be made thin and used as a low heat capacity pressure roller. The heat capacity of the pressure roller used in the belt fixing device of the present invention is 36 cal/° C. or lower (in this embodiment, the pressure roller is 40 mm to 60 mm in diameter, and 0.3 mm to 1.5 mm in thickness).

As described so far, the twelfth embodiment of the present invention is a belt fixing device comprising the fixing roller 2, the heating roller 1, the endless-type fixing belt 3 stretched over the heating roller and the fixing roller 2, the pressure roller 4 facing the fixing roller 2 via the fixing belt 3, and the two heaters 5 and 14 disposed in the heating roller 1 and the pressure roller 4, respectively. In this belt fixing device, the fixing pressure in the first fixing process portion, where the pressure roller 4 is brought into contact with the fixing belt 3 without pressing the fixing roller 2 via the fixing belt 3, is set low enough to prevent wrinkles in a material onto which a toner image is to be fixed. The fixing pressure in the second fixing process portion, where the pressure roller 4 presses the fixing roller 2 via the fixing belt 3, is set so that desired fixing can be performed. The temperatures of fixing belt 3 and the pressure roller 4 are set so that the temperature difference between the fixing belt 3 and the pressure roller 4 will be 40° C. or lower during the rotating operation. Thus, uneven glossiness in images can be prevented, and better fixing effects can be obtained.

A thirteenth embodiment of the present invention is provided with a controller for switching on the heaters 5 and 14 depending on the type of material onto which a toner image is to be fixed. This controller keeps one of the heaters 5 and 14 off and switches on and off the other one in a mode in which normal paper (100 g/m$^2$) is selected as a material onto which a toner image is to be fixed in the image forming apparatus. The controller switches on and off both the heaters 5 and 14 in a mode in which special paper (paper heavier than 100 g/m$^2$ or OHP sheets) is selected as a material onto which a toner image is to be fixed in the image forming apparatus. As a result, excellent fixing effect can be obtained, regardless of the type of material. Also, unlike in the conventional thermal roller fixing device, it is not necessary to raise the fixing temperature (which results in smaller restrictions on hot offset) or to greatly reduce the image forming speed when special paper is used.

As described so far, the thirteenth embodiment is a belt fixing device comprising the fixing roller 2, the heating roller 1, the endless-type fixing belt 3 stretched over the heating roller 1 and the fixing roller 2, the pressure roller 4 facing the fixing roller 2 via the fixing belt 3, and the two heaters 5 and 14 disposed inside the heating roller 1 and the pressure roller 4, respectively. In this belt fixing device, the fixing pressure in the first fixing process portion, where the pressure roller 4 is in contact with the fixing belt 3 without pressing the fixing roller 2 via the fixing belt 3, is set low enough to prevent wrinkles in the material, onto which a toner image is to be fixed. The fixing pressure in the second fixing process portion, where the pressure roller 4 presses the fixing roller 2 via the fixing belt 3, is set so that desired fixing can be performed. In the normal paper mode, the controller switches on either of the heaters 5 and 14. In the special paper mode, the controller switches on both the heaters 5 and 14. Thus, excellent fixing effects can be obtained, regardless of the type of material onto which a toner image is to be fixed.

In the thirteenth embodiment, the controller may keep one of the heaters 5 and 14 off and switches on and off the other one in a monochromatic mode, instead of the normal paper mode, in an image forming apparatus which selectively performs monochromatic image formation and color image formation. In such a case, the controller switches on and off both the heaters 5 and 14 in a color mode, instead of the special paper mode.

A fourteenth embodiment of the present invention is provided with a controller for changing the set temperatures of the fixing belt 3 and the pressure roller 4 depending on the image formation mode. In an image forming apparatus which selectively performs image formation in a one-side image formation mode for forming an image on only one side of a material onto which the image is to be fixed, or in a two-side image formation mode for forming an image on both sides of the material, the controller sets the temperature of the fixing belt 3 lower than the surface temperature of the pressure roller 4 in the one-side image formation mode, while it sets the temperature of the fixing belt 3 higher than the surface temperature of the pressure roller 4 in the two-side image formation mode.

In the one-side image formation mode, as in the twelfth embodiment, the amount of heat supply from the pressure roller 4 to the reverse side of a material onto which a toner Image is to be fixed is made as large as possible, while the amount of heat supply from the fixing belt 3 to the front side of the material is made as small as possible. The interface temperature between the fixing belt 3 and the toners is thus lowered, and hot offset is more effectively prevented (see FIGS. 27 and 28).

In the two-side image formation mode, an image fixed on the front side of the material receives heat from the pressure roller 4 when passing again through the fixing nip portion for fixing an image on the reverse side. As a result, more glossiness is added to the image on the front side, which might cause a difference in glossiness between the front side and the reverse side. To avoid such a situation, the temperature of the fixing belt 3 is set higher than the pressure roller 4, so that the image on the front side of the material will not receive extra heat. Thus, excellent fixing effects can be obtained.

As described so far, the fourteenth embodiment of the present invention is a belt fixing device comprising the fixing roller 2, the heating roller 1, the endless-type fixing belt 3 stretched over the heating roller 1 and the fixing roller 2, the pressure roller 4 facing the fixing roller 2 via the fixing belt 3, and the two heaters 5 and 14 disposed inside the heating roller I and the pressure roller 4, respectively. In this belt fixing device, the fixing pressure in the first fixing process portion, where the pressure roller 4 is in contact with the fixing belt 3 without pressing the fixing roller 2 via the fixing belt 3, is set low enough to prevent wrinkles in the material, onto which a toner image is to be fixed. The fixing pressure in the second fixing process portion, where the pressure roller 4 presses the fixing roller 2 via the fixing belt 3, is set so that desired fixing can be performed. When the one-side image formation mode is selected, the temperature of the fixing belt 3 is set lower than the pressure roller during the rotating operation. When the two-side image formation mode is selected, the temperature of the fixing belt 3 is set higher than the temperature of the pressure roller 4 during the rotating operation. Accordingly, the interface temperature between the fixing belt and the toners is low in the one-side image formation mode, so that hot offset can be more effectively prevented. In the two-side image formation mode, the difference in glossiness between the front side and the reverse side of the material can be made as small as possible, so that excellent fixing effects can be obtained.

In a fifteenth embodiment of the present invention, the controller of the fourteenth embodiment sets the temperatures for the fixing belt 3 and the pressure roller 4 so that the temperature of the fixing belt 3 is 30° C. or higher than the temperature of the pressure roller 4 in the two-side image formation mode. By doing so, the difference in glossiness between the front side and the reverse side can be within a visually allowable range.

In a case where an image forming apparatus forms an image on both sides of a recording sheet in a two-side image formation mode in the first embodiment, there is a difference in amount of fixing heat to be given to the toner between the front side and the reverse side of the recording sheet, due to the set temperatures of the fixing belt 3 and the pressure roller 4. As a result, a difference is caused in image glossiness between the front side and the reverse side of the recording sheet.

Figure 32:
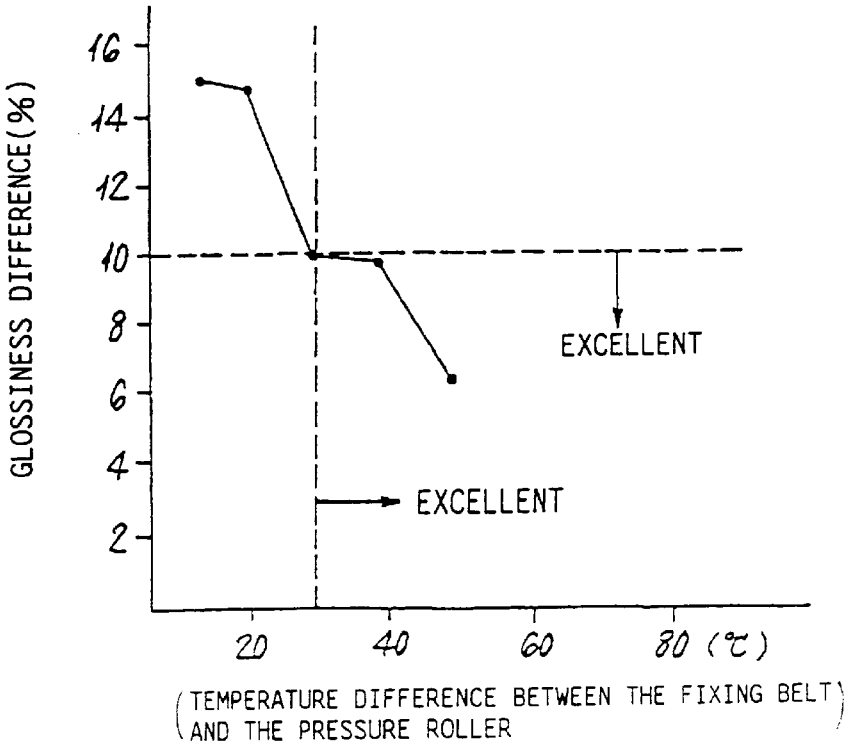
FIG. 32 presents a graph showing the examination results in the fifteenth embodiment of the present invention.

In the fifteenth embodiment, when the two-side image formation mode is selected, the temperature of the fixing belt 3 is set higher than the surface temperature of the pressure roller 4, so that the temperature difference between the fixing belt 3 and the pressure roller 4 is 30° C. or more. FIG. 32 shows the difference in image glossiness between the front side and the reverse side of a recording sheet in a case where the temperature of the fixing belt 3 is 130° C. while the temperature of the pressure roller 4 is varied.

As shown in FIG. 32, when the temperature difference between the fixing belt 3 and the pressure roller 4 is 20° C., and the temperature of the pressure roller 4 is 110° C., the image glossiness on the front side of the recording sheet is approximately 29% on average while the image glossiness on the reverse side of the recording sheet is approximately 14% on average. When the temperature difference between the fixing belt 3 and the pressure roller 4 is 30° C., and the temperature of the pressure roller 4 is 100° C., the image glossiness on the front side of the recording sheet is approximately 23% on average while the image glossiness on the reverse side of the recording sheet is approximately 13% on average. When the temperature difference between the fixing belt 3 and the pressure roller 4 is 50° C., and the temperature of the pressure roller 4 is 80° C., the image glossiness on the front side of the recording sheet is approximately 13% on average while the image glossiness on the reverse side of the recording sheet is approximately 7% on average.

The visually allowable image glossiness difference is 10% or lower. In view of this, the temperature difference between the fixing belt 3 and the pressure roller 4 should be 30° C. or greater. Since there is a great correlation between the fixing temperature and the image glossiness, the results of an experiment with set temperatures different from those in the above example are substantially the same as shown in FIG. 32.

It is easy to set the pressure roller 4 at a desired temperature. However, as the temperature of the pressure roller 4 gradually rises during a continuous printing operation, a cooling unit is necessary to prevent such a temperature rise. For instance, a cooling roller or a cooling fan can be brought into contact with the pressure roller or switched on when necessary in the two-side image formation mode.

To reduce the image glossiness difference between the front side and the reverse side of a recording sheet, the surface roughness of the release layer on the surface of the pressure roller may be made high so as not to add extra glossiness to the image formed surface of the pressure roller. The surface roughness of the release layer on the surface of the pressure roller can be increased by dispersing an external additive agent such as carbon, graphite, or titanium oxide, in the center and on the surface of the release layer.

As described so far, in the fifteenth embodiment, when the two-side image formation mode is selected, the temperature of the fixing belt 3 is set higher than the temperature of the pressure roller 4 during the rotating operation, so that the temperature difference between the fixing belt 3 and the pressure roller 4 can be 30° C. or greater. Thus, the image glossiness difference between the front side and the reverse side of a recording sheet can be visually allowable, and excellent fixing effects can be obtained regardless of image formation mode.

Figure 29:
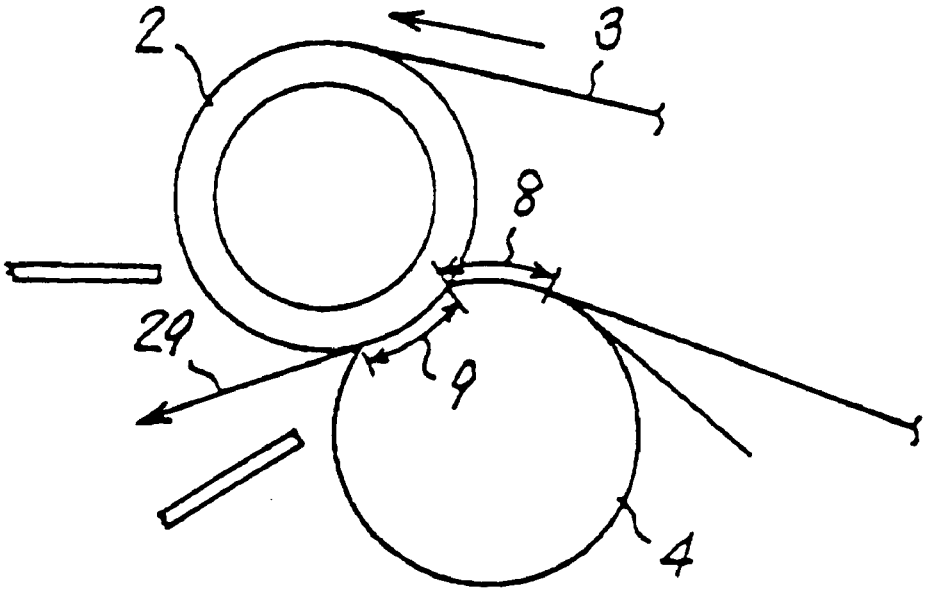
FIG. 29 is a schematic view of one part of a sixteenth embodiment of the present invention.

In a sixteenth embodiment of the present invention, the surface hardness of the fixing roller 2 is made greater than the surface hardness of the pressure roller 4, as shown in FIG. 29 of the twelfth embodiment. The nip in the first fixing process portion 8 has a convex shape, while the nip in the second fixing process portion 9 has a concave shape. With such a structure, a material onto which a toner image is to be fixed can be prevented from curling, and no separation claw is necessary to prevent scratches on the surfaces of the rollers. Also, the heater 14 may be provided to the pressure roller 4, though it is not necessary.

In the above structure of the sixteenth embodiment, a curl in the material can be corrected and prevented. In the twelfth embodiment, a separation claw is unnecessary on the fixing roller 2, but it is necessary on the pressure roller 4. In this embodiment, however, a separation claw is unnecessary on the pressure roller 4, as the nip in the second fixing process portion on the outlet side has a concave shape in a direction to prevent the material from winding around the pressure roller 4.

As described so far, the belt fixing device of the sixteenth embodiment comprises the fixing roller 2, the heating roller 1, the endless-type fixing belt 3 stretched over the heating roller 1 and the fixing roller 2, the pressure roller 4 facing the fixing roller 2 via the fixing belt 3, the two heaters 5 and 14 disposed inside the heating roller 1 and the pressure roller 4, respectively. The fixing pressure in the first fixing process portion, where the pressure roller 4 is in contact with the fixing belt 3 without pressing the fixing roller 2 via the fixing belt 3, is set low enough to prevent wrinkles in a material onto which an image Is to be fixed. The fixing pressure in the second fixing process portion, where the pressure roller 4 presses the fixing roller 2 via the fixing belt 3, is set so that desired fixing can be performed. In this belt fixing device, the surface hardness of the fixing roller 2 is greater than the surface hardness of the pressure roller 4. The nip in the first fixing process portion has a convex shape, while the nip in the second fixing process portion has a concave shape. Thus, a separation claw is unnecessary, and the material can be prevented from curling without a curl removing roller.

In a case where the surface hardness of the fixing roller 2 is smaller than the surface hardness of the pressure roller 4, and where the nip in the second fixing process portion has a convex shape, a recording sheet winds around the pressure roller 4, and a separation claw is necessary to prevent it. Still, a recording sheet does not wind around the fixing roller 2, and a separation claw is unnecessary.

Figure 30:
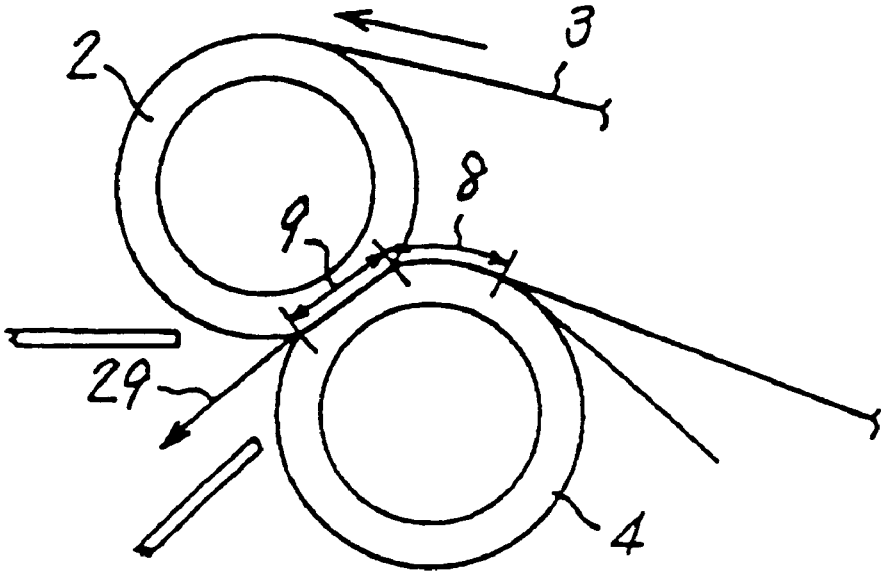
FIG. 30 is a schematic view of one part of a seventeenth embodiment of the present invention.

In a seventeenth embodiment of the present invention, the surface hardness of the fixing roller 2 is substantially the same as the surface hardness of the pressure roller 4, as shown in FIG. 30 of the twelfth embodiment. The nip in the second fixing process portion 9 is straight, so that a separation claw is unnecessary to prevent scratches on the rollers. Also, the heater 14 may be provided to the pressure roller 4, though it is not necessary.

In the twelfth embodiment, a separation claw is unnecessary on the fixing roller 2, but it is necessary on the pressure roller 4. In the seventeenth embodiment, however, a separation claw is unnecessary on the pressure roller 4, as the nip in the second fixing process portion 9 on the outlet side is straight in a direction to prevent the material from winding around the pressure roller 4.

As described so far, the belt fixing device of the sixteenth embodiment comprises the fixing roller 2, the heating roller 1, the endless-type fixing belt 3 stretched over the heating roller 1 and the fixing roller 2, the pressure roller 4 facing the fixing roller 2 via the fixing belt 3, the two heaters 5 and 14 disposed inside the heating roller 1 and the pressure roller 4, respectively. The fixing pressure in the first fixing process portion, where the pressure roller 4 is in contact with the fixing belt 3 without pressing the fixing roller 2 via the fixing belt 3, is set low enough to prevent wrinkles in a material onto which an image is to be fixed. The fixing pressure in the second fixing process portion, where the pressure roller 4 presses the fixing roller 2 via the fixing belt 3, is set so that desired fixing can be performed. In this belt fixing device, the surface hardness of the fixing roller 2 is substantially the same as the surface hardness of the pressure roller 4. The nip in the second fixing process portion is straight, so that a separation claw is unnecessary.

In a case where the surface hardness of the fixing roller 2 is smaller than the surface hardness of the pressure roller 4, and where the nip in the second fixing process portion has a convex shape, a recording sheet winds around the pressure roller 4, and a separation claw is necessary to prevent it. Still, a recording sheet does not wind around the fixing roller 2, and a separation claw is unnecessary.

What is claimed is:

1. A belt fixing device which comprises a fixing roller, a heating roller, an endless-type fixing belt stretched over the heating roller and the fixing roller, and a pressure roller facing the fixing roller via the fixing belt, and which fixes a toner image formed on a material to be transported between the pressure roller and the fixing belt, wherein the material is transported from the heating roller toward the fixing roller along the fixing belt, and brought to a fixing portion formed between the fixing belt and the pressure roller, wherein the fixing roller has no heat source, wherein the fixing roller presses a toner image formed surface of the material via the fixing belt in the fixing portion, wherein a heater for heating the fixing belt is disposed in both of the pressure roller and the heating roller, wherein a fixing pressure in a first fixing process portion where the pressure roller is in contact with the fixing belt without pressing the fixing roller via the fixing belt is set so low that no wrinkles appear on the material, wherein a fixing pressure in a second fixing process portion where the pressure roller presses the fixing roller via the fixing belt is set so that desired fixing can be performed, and wherein the fixing belt is arranged such that the material is separated from the fixing belt at an end of the second fixing process portion.

2. The belt fixing device according to claim 1, wherein the fixing pressure on the material in the first fixing process portion is 1 kgf/cm$^2$ or lower, and the fixing pressure on the material in the second fixing process portion is higher than the fixing pressure in the first fixing process portion.

3. A belt fixing device which comprises a fixing roller, an endless-type fixing belt stretched over the fixing roller, heating means for heating the fixing belt, a pressure roller facing the fixing roller via the fixing belt, and a fixing belt heater provided for heating both of the pressure roller and the heating means, wherein the material is transported from the heating roller toward the fixing roller along the fixing belt, and brought to a fixing portion formed between the fixing belt and the pressure roller, the fixing roller has no heat source, the fixing roller presses a toner image formed surface of the material via the fixing belt in the fixing portion, a fixing pressure in a first fixing process portion, where the pressure roller is in contact with the fixing belt without pressing the fixing roller in the direction of transporting a material onto which an image is to be fixed, is set so low that no wrinkles appear in the material, and a fixing pressure in a second fixing process portion, where the pressure roller presses the fixing roller via the fixing belt, is set so that desired fixing can be performed on the material, wherein the fixing belt is arranged such that the material is separated from the fixing belt at an end of the second fixing process portion, wherein the distance between a point where the fixing belt separates from a spot heated by the heating means and a point where the fixing belt is first brought into contact with the pressure roller is 20 mm or shorter.

4. A belt fixing device which comprises a fixing a roller, a heating roller, an endless-type fixing belt stretched over the heating roller and the fixing roller, a pressure roller facing the fixing roller via the fixing belt, and a fixing belt heater provided in both of the pressure roller and the heating roller, wherein the material is transported from the heating roller toward the fixing roller along the fixing belt, and brought to a fixing portion formed between the fixing belt and the pressure roller, the fixing roller has no heat source, the fixing roller presses a toner image formed surface of the material via the fixing belt in the fixing portion, wherein a fixing pressure in a first fixing process portion, where the pressure roller presses the heating roller via the fixing belt without pressing the fixing roller in a direction of transporting a material onto which an image is to be fixed, is set at 0.5 kgf/cm$^2$ or lower, so as to prevent wrinkles in the material, and a fixing pressure in a second fixing process portion, where the pressure roller presses the fixing roller via the fixing belt, is set so that desired fixing can be performed, wherein the fixing belt is arranged such that the material is separated from the fixing belt at an end of the second fixing process portion.

5. A belt fixing device comprises a fixing roller, a heating roller, an endless-type fixing belt stretched over the heating roller and the fixing roller, a pressure roller facing the fixing roller via the fixing belt, and a fixing belt heater disposed in both of the pressure roller and the heating roller, wherein the material is transported from the heating roller toward the fixing roller long the fixing belt, and brought to a fixing portion formed between the fixing belt and the pressure roller, the fixing roller has no heat source, the fixing roller presses a toner image formed surface of the material via the fixing belt in the fixing portion, a fixing pressure in a first fixing process portion, where the pressure roller is in contact with the fixing belt without pressing the fixing roller in a direction of transporting a material onto which an image is to be fixed, is set so low that no wrinkles appear in the material, and a fixing pressure in a second fixing process portion, where the pressure roller presses the fixing roller via the fixing belt, is set so that desired fixing can be performed, wherein the fixing belt is arranged such that the material is separated from the fixing belt at an end of the second fixing process portion, wherein a guide member is provided to an inner side of the fixing belt in the vicinity of a position where the fixing belt heated by the heating roller is first brought into contact with the pressure roller, and the heating roller is arranged so that the fixing belt (3) stays away from the material having a non-fixed toner image thereon while the fixing belt is situated between a point where the fixing belt separates from the heating roller and a point where the fixing belt is first brought into contact with the pressure roller.

6. A belt fixing device which comprises a fixing roller, a heating roller, an endless-type fixing belt (3) stretched over the heating roller and the fixing roller, a pressure roller facing the fixing roller via the fixing belt, a fixing belt heater disposed in both of the pressure roller and the heating roller, and a guide member disposed on an inner side of the fixing belt in the vicinity of a spot where the fixing belt is first brought into contact with the pressure roller in a transporting direction of a material onto which a toner image is to be fixed, wherein the material is transported from the heating roller toward the fixing roller along the fixing belt, and brought to a fixing portion formed between the fixing belt and the pressure roller, the fixing roller has no heat source, the fixing roller presses a toner image formed surface of the material via the fixing belt in the fixing portion, the heating roller is arranged so that the fixing belt stays away from the material, onto which a non-fixed toner image is to be fixed, between a spot where the fixing belt separates from the heating roller and a spot where the fixing belt is first brought into contact with the pressure roller, wherein a fixing pressure in a first fixing process portion, where the pressure roller presses the guide member via the fixing belt, is set at 0.5 kgf/cm$^2$ or lower, so as to prevent wrinkles in the material, and a fixing pressure in a second fixing process portion, where the pressure roller presses the fixing roller via the fixing belt, is set so that desired fixing can be performed, wherein the fixing belt is arranged such that the material is separated from the fixing belt at an end of the second fixing process portion.

7. A belt fixing device which comprises a fixing a roller, a heating roller, an endless-type fixing belt stretched over the heating roller and the fixing roller, a pressure roller facing the fixing roller via the fixing belt, and two heaters disposed inside the heating roller and the pressure roller, respectively, wherein the material is transported from the heating roller toward the fixing roller along the fixing belt, and brought to a fixing portion formed between the fixing belt and the pressure roller, the fixing roller has no heat source, the fixing roller presses a toner image formed surface of the material via the fixing belt in the fixing portion, a fixing pressure in a first fixing process portion, where the pressure roller is in contact with the fixing belt without pressing the fixing roller via the fixing belt, is set low enough to prevent wrinkles in a material onto which a toner image is to be fixed, and a fixing pressure in a second fixing process portion, where the pressure roller presses the fixing roller via the fixing belt, is set so that desired fixing can be performed, wherein the fixing belt is arranged such that the material is separated from the fixing belt at an end of the second fixing process portion, wherein temperatures of the fixing belt and the pressure roller are set so that a temperature difference between the fixing belt and the pressure roller is 40° C. or smaller during a rotating operation.

8. A belt fixing device which comprises a fixing roller, a heating roller, an endless-type fixing belt stretched over the heating roller and the fixing roller, a pressure roller facing the fixing roller via the fixing belt, and two heaters disposed inside the heating roller and the pressure roller, respectively, wherein the material is transported from the heating roller toward the fixing roller along the fixing belt, and brought to a fixing portion formed between the fixing belt and the pressure roller, the fixing roller has no heat source, the fixing roller presses a toner image formed surface of the material via the fixing belt in the fixing portion, a fixing pressure in a first fixing process portion, where the pressure roller is in contact with the fixing belt without pressing the fixing roller via the fixing belt, is set low enough to prevent wrinkles in a material onto which a toner image is to be fixed, and a fixing pressure in a second fixing process portion, where the pressure roller presses the fixing roller via the fixing belt, is set so that desired fixing can be performed, wherein the fixing belt is arranged such that the material is separated from the fixing belt at an end of the second fixing process portion, further comprising means for switching on either of the two heaters when a normal paper mode is selected to use normal paper as the material, and for switching on both heaters when a special paper mode is selected to use special paper as the material.

9. A belt fixing device which comprises a fixing roller, a heating roller, an endless-type fixing belt stretched over the heating roller and the fixing roller, a pressure roller facing the fixing roller via the fixing belt, and two heaters disposed inside the heating roller and the pressure roller, respectively, wherein the material is transported from the beating roller toward the fixing roller along the fixing belt, and brought to a fixing portion formed between the fixing belt and the pressure roller, the fixing roller has no heat source, the fixing roller presses a toner image formed surface of the material via the fixing belt in the fixing portion, a fixing pressure in a first fixing process portion, where the pressure roller is in contact with the fixing belt without pressing the fixing roller via the fixing belt, is set low enough to prevent wrinkles in a material onto which a toner image is to be fixed, and a fixing pressure in a second fixing process portion, where the pressure roller presses the fixing roller via the fixing belt, is set so that desired fixing can be performed, wherein the fixing belt is arranged such that the material is separated from the fixing belt at an end of the second fixing process portion, wherein when a one-side image formation mode is selected, a temperature of the fixing belt is set lower than a temperature of the pressure roller during a rotating operation, and when a two-side image formation mode is selected, the temperature of the fixing belt is set higher than the temperature of the pressure roller during the rotation operation.

10. The belt fixing device according to claim 9, wherein when the two-side image formation mode is selected, the temperature of the fixing belt is set higher than the temperature of the pressure roller during the rotating operation, so that a temperature difference between the fixing belt and the pressure roller is 30° C. or greater.

11. A belt fixing device which comprises a fixing roller, a heating roller, an endless-type fixing belt stretched over the heating roller and the fixing roller, a pressure roller facing the fixing roller via the fixing belt, and a heater provided in both of the heating roller and the pressure roller, wherein the material is transported from the heating roller toward the fixing roller along the fixing belt, and brought to a fixing portion formed between the fixing belt and the pressure roller, the fixing roller has no heat source, the fixing roller presses a toner image formed surface of the material via the fixing belt in the fixing portion, a fixing pressure in a first fixing process portion, where the pressure roller is in contact with the fixing belt without pressing the fixing roller via the fixing belt, is set low enough to prevent wrinkles in a material onto which a toner image is to be fixed, and a fixing pressure in a second fixing process portion, where the pressure roller presses the fixing roller via the fixing belt, is set so that desired fixing can be performed, wherein the fixing belt is arranged such that the material is separated from the fixing belt at an end of the second fixing process portion, wherein a surface hardness of the fixing roller is greater than a surface hardness of the pressure roller, and a nip in the first fixing process portion has a convex shape, while a nip in the second fixing process portion has a concave shape.

12. A belt fixing device which comprises a fixing roller, a heating roller, an endless-type fixing belt stretched over the heating roller and the fixing roller, a pressure roller facing the fixing roller via the fixing belt, and a heater provided in both of the heating roller and the pressure roller, wherein the fixing roller has no heat source, the fixing roller presses a toner image formed surface of the material via the fixing belt in the fixing portion, a fixing pressure in a first fixing process portion, where the pressure roller is in contact with the fixing belt without pressing the fixing roller via the fixing belt, is set low enough to prevent wrinkles in a material onto which a toner image is to be fixed, and a fixing pressure in a second fixing process portion, where the pressure roller presses the fixing roller via the fixing belt, is set so that desired fixing can be performed, wherein the fixing belt is arranged such that the material is separated from the fixing belt at an end of the second fixing process portion, wherein a surface hardness of the fixing roller is substantially the same as a surface hardness of the pressure roller, and a nip in the second fixing process portion is straight.

* * * * *